US006149154A

United States Patent [19]

Grauzer et al.

[11] Patent Number: 6,149,154

[45] Date of Patent: Nov. 21, 2000

[54] DEVICE AND METHOD FOR FORMING HANDS OF RANDOMLY ARRANGED CARDS

[75] Inventors: Attila Grauzer, Plymouth; Feraidoon Bourbour, Minneapolis; James Philip Helgesen, Eden Prairie; Troy Nelson, St. Michael; Robert J. Rynda; Paul K. Scheper, both of Eden Prairie; James Bernard Stasson, Chanhassen; Ronald R. Swanson, Delano, all of Minn.

[73] Assignee: Shuffle Master Gaming, Las Vegas, Nev.

[21] Appl. No.: 09/060,627

[22] Filed: Apr. 15, 1998

[51] Int. Cl.[7] ..... A63F 1/12; A63F 1/14

[52] U.S. Cl. ..... 273/149 R; 273/149 P

[58] Field of Search ..... 273/149 R, 149 P, 273/148 R

[56] References Cited

U.S. PATENT DOCUMENTS

| | | | |
|---|---|---|---|
| 793,489 | 6/1905 | Williams | 273/148 A |
| 2,001,220 | 5/1935 | Smith et al. | 273/149 R |
| 2,001,918 | 5/1935 | Nevius | 273/148 A |
| 2,016,030 | 10/1935 | Woodruff et al. | 273/149 R |
| 2,043,343 | 6/1936 | Warner | 273/148 A |
| 2,778,644 | 1/1957 | Stephenson | 273/149 R |
| 2,937,739 | 5/1960 | Levy | 198/352 |
| 2,950,005 | 8/1960 | MacDonald | 273/148 A |
| 3,312,473 | 4/1967 | Friedman et al. | 273/149 R |
| 3,690,670 | 9/1972 | Cassady et al. | 273/149 P |
| 3,897,954 | 8/1975 | Erickson et al. | 273/149 R |
| 4,232,861 | 11/1980 | Maul | 271/287 |
| 4,361,393 | 11/1982 | Noto | 355/3 |
| 4,368,972 | 1/1983 | Naramore | 355/14 |
| 4,385,827 | 5/1983 | Naramore | 355/14 |
| 4,497,488 | 2/1985 | Plevyak et al. | 273/149 R |
| 4,513,969 | 4/1985 | Samsel, Jr. | 273/149 R |
| 4,515,367 | 5/1985 | Howard | 273/149 R |
| 4,566,782 | 1/1986 | Britt et al. | 355/14 |
| 4,586,712 | 5/1986 | Lorber et al. | 273/149 R |
| 4,659,082 | 4/1987 | Greenberg | 273/149 R |
| 4,741,524 | 5/1988 | Bromage | 271/208 |
| 4,750,743 | 6/1988 | Nicoletti | 273/148 A |
| 4,770,421 | 9/1988 | Hoffman | 273/149 R |
| 4,807,884 | 2/1989 | Breeding | 273/149 R |
| 4,832,342 | 5/1989 | Plevyak et al. | 273/149 R |
| 4,900,009 | 2/1990 | Kithara et al. | 271/296 |
| 4,969,648 | 11/1990 | Hollinger et al. | 273/149 R |
| 5,000,453 | 3/1991 | Stevens et al. | 273/149 R |
| 5,121,921 | 6/1992 | Friedman et al. | 273/149 P |
| 5,240,140 | 8/1993 | Huen | 273/149 R |
| 5,288,081 | 2/1994 | Breeding | 273/292 |
| 5,356,145 | 10/1994 | Verschoor | 273/149 R |
| 5,382,024 | 1/1995 | Blaha | 273/149 R |
| 5,390,910 | 2/1995 | Mandel et al. | 271/296 |
| 5,431,399 | 7/1995 | Kelley | 273/149 P |
| 5,437,462 | 8/1995 | Breeding | 273/292 |
| 5,584,483 | 12/1996 | Sines et al. | 273/149 R |
| 5,676,372 | 10/1997 | Sines et al. | 273/149 R |
| 5,683,085 | 11/1997 | Johnson et al. | 273/149 R |
| 5,690,324 | 11/1997 | Otomo et al. | 270/58.02 |

FOREIGN PATENT DOCUMENTS 9840136 9/1998 WIPO .

OTHER PUBLICATIONS

"Super Contract Bridge", Scarne's Encyclopedia of Games, Harper & Row, Publishers, p. 153, 1973.

*Primary Examiner*—Benjamin H. Layno

*Attorney, Agent, or Firm*—Mark A. Litman & Associates, P.A.

[57] ABSTRACT

The present invention provides an apparatus and method for moving playing cards from a first group of cards into plural hands of cards, wherein each of the hands contains a random arrangement of the same quantity of cards. The apparatus comprises a card receiver for receiving the first group of cards, a single stack of card-receiving compartments generally adjacent to the card receiver, the stack generally vertically movable, an elevator for moving the stack, a card-moving mechanism between the card receiver and the stack, and a microprocessor that controls the card-moving mechanism and the elevator so that an individual card is moved into an identified compartment. The number of compartments receiving cards and the number of cards moved to each compartment may be selected.

39 Claims, 20 Drawing Sheets

200
234
240
242
262
260B
244
248
246
1
2
3
4
5
6
7
8
9
260A
238
236
230
232
CONTROL PANEL
MPU
250
228

DEVICE AND METHOD FOR FORMING HANDS OF RANDOMLY ARRANGED CARDS

BACKGROUND

1. Field

The present invention relates to devices for handling cards, including cards known as "playing cards." In particular, it relates to an electromechanical machine for organizing or arranging playing cards into a plurality of hands, wherein each hand is formed by a selected number of randomly arranged cards.

2. Related Art

Wagering games based on the outcome of randomly generated or selected symbols are well known. Such games are widely played in gambling establishments such as casinos and include card games wherein the symbols comprise familiar, common playing cards. Card games such as twenty-one or blackjack, poker and the like are excellent card games for use in casinos. Desirable attributes of casino card games are that they are exciting, that they can be learned and understood easily by players, and that they move or are played rapidly to their wager-resolving outcome.

From the perspective of players, the time the dealer must spend in shuffling diminishes the excitement of the game. From the perspective of casinos, shuffling time reduces the number of wagers placed and resolved in a given amount of time, thereby reducing revenue. Casinos would like to increase the amount of revenue generated by a game without changing games, particularly a popular game, and without increasing the minimum size of wagers. One approach to speeding play is directed specifically to the fact that playing time is decreased by shuffling and dealing. This approach has lead to the development of electromechanical or mechanical card shuffling devices. Such devices increase the speed of shuffling and dealing, thereby increasing playing time. Such devices also add to the excitement of a game by reducing the time the dealer or house has to spend in preparing to play the game.

U.S. Pat. Nos. 4,513,969 (Samsel, Jr.) and 4,515,367 (Howard) disclose automatic card shufflers. The Samsel, Jr. patent discloses a card shuffler having a housing with two wells for receiving stacks of cards. A first extractor selects, removes and intermixes the bottommost card from each stack and delivers the intermixed cards to a storage compartment. A second extractor sequentially removes the bottommost card from the storage compartment and delivers it to a typical shoe from which the dealer may take it for presentation to the players. The Howard patent discloses a card mixer for randomly interleaving cards including a carriage supported ejector for ejecting a group of cards (approximately two playing decks in number) which may then be removed manually from the shuffler or dropped automatically into a chute for delivery to a typical dealing shoe.

U.S. Pat. No. 4,586,712 (Lorber et al.) discloses an automatic shuffling apparatus designed to intermix multiple decks of cards under the programmed control of a computer. The Lorber et al. apparatus is a carousel-type shuffler having a container, a storage device for storing shuffled playing cards, a removing device and an inserting device for intermixing the playing cards in the container, a dealing shoe and supplying means for supplying the shuffled playing cards from the storage device to the dealing shoe.

U.S. Pat. No. 5,000,453 (Stevens et al.) discloses an apparatus for automatically shuffling cards. The Stevens et al. machine includes three contiguous magazines with an elevatable platform in the center magazine only. Unshuffled cards are placed in the center magazine and the spitting rollers at the top of the magazine spit the cards randomly to the left and right magazines in a simultaneous cutting and shuffling step. The cards are moved back into the center magazine by direct lateral movement of each shuffled stack, placing one stack on top of the other to stack all cards in a shuffled stack in the center magazine. The order of the cards in each stack does not change in moving from the right and left magazines into the center magazine.

U.S. Pat. No. 3,897,954 (Erickson et al.) discloses the concept of delivering cards one at a time, into one of a number vertically stacked card shuffling compartments. The Erickson patent also discloses using a logic circuit to determine the sequence for determining the delivery location of a card, and that a card shuffler can be used to deal stacks of shuffled cards to a player. U.S. Pat. No. 5,241,140 (Huen) discloses a card dispenser which dispenses or deals cards in four discrete directions onto a playing surface, and U.S. Pat. Nos. 793,489 (Williams), 2,001,918 (Nevius), 2,043,343 (Warner) and 3,312,473 (Friedman et al.) disclose various card holders some of which include recesses (e.g., Friedman et al.) to facilitate removal of cards. U.S. Pat. Nos. 2,950,005 (MacDonald) and 3,690,670 (Cassady et al.) disclose card sorting devices which require specially marked cards, clearly undesirable for gaming and casino play.

U.S. Pat. No. 4,770,421 (Hoffman) discloses a card shuffling device including a card loading station with a conveyor belt. The belt moves the lowermost card in a stack onto a distribution elevator whereby a stack of cards is accumulated on the distribution elevator. Adjacent to the elevator is a vertical stack of mixing pockets. A microprocessor preprogrammed with a finite number of distribution schedules sends a sequence of signals to the elevator corresponding to heights called out in the schedule. Each distribution schedule comprises a preselected distribution sequence which is fixed as opposed to random. Single cards are moved into the respective pocket at that height. The distribution schedule is either randomly selected or schedules are executed in sequence. When the microprocessor completes the execution of a single distribution cycle, the cards are removed a stack at a time and loaded into a second elevator. The second elevator delivers cards to an output reservoir. Thus, the Hoffman patent requires a two step shuffle, i.e., a program is required to select the order in which stacks are loaded and moved onto the second elevator and delivers a shuffled deck or decks. The Hoffman patent does not disclose randomly selecting a location within the vertical stack for delivering each card. Nor does the patent disclose a single stage process which randomly delivers hands of shuffled cards with a degree of randomness satisfactory to casinos and players. Further, there is no disclosure in the Hoffman patent about how to deliver a preselected number of cards to a preselected number of hands ready for use by players or participants in a game. Another card handling apparatus with an elevator is disclosed in U.S. Pat. No. 5,683,085 (Johnson et al.). U.S. Pat. No. 4,750,743 (Nicoletti) discloses a playing card dispenser including an inclined surface and a card pusher for urging cards down the inclined surface.

Other known card shuffling devices are disclosed in U.S. Pat. Nos. 2,778,644 (Stephenson), 4,497,488 (Plevyak et al.), 4,807,884 and 5,275,411 (both Breeding) and 5,695,189 (Breeding et al.). The Breeding patents disclose machines for automatically shuffling a single deck of cards including a deck receiving zone, a carriage section for separating a deck into two deck portions, a sloped mechanism positioned between adjacent corners of the deck portions, and an apparatus for snapping the cards over the sloped mechanism to interleave the cards.

The Breeding single deck shufflers used in connection with LET IT RIDE(D Stud Poker are programmed to first shuffle a deck of cards, and then sequentially deliver hands of a preselected number for each player. LET IT RIDE® stud poker is the subject of U.S. Pat. Nos. 5,288,081 and 5,437,462 (Breeding), which are herein incorporated by reference. The Breeding single deck shuffler delivers three cards from the shuffled deck in sequence to a receiving rack. The dealer removes the first hand from the rack. Then, the next hand is automatically delivered. The dealer inputs the number of players, and the shuffler deals out that many hands plus a dealer hand.

The Breeding single deck shufflers are capable of shuffling a single deck and delivering seven player hands plus a dealer hand in approximately 60 seconds. The Breeding shuffler is a complex electromechanical device which requires tuning and adjustment during installation. The shufflers also require periodic adjustment.

The Breeding et al. patent is directed to a shuffling machine for shuffling multiple decks of cards with three magazines wherein unshuffled cards are cut then shuffled.

Although the devices disclosed in the preceding patents, particularly the Breeding machines, provide improvements in card shuffling devices, none discloses or suggests a device and method for providing a plurality of hands of cards, wherein the hands are ready for play and wherein each comprises a randomly selected arrangement of cards, without first randomly shuffling the entire deck. A device and method which provides a plurality of ready-to-play hands of a selected number of randomly arranged cards at a greater speed than known devices without shuffling the entire deck or decks would speed and facilitate the casino play of card games.

SUMMARY

The present invention provides an electromechanical card handling apparatus and method for creating or generating a plurality of hands of cards from a group of unshuffled cards wherein each hand contains a predetermined number of randomly selected or arranged cards. The apparatus and, thus, the card handling method or process, is controlled by a programmable microprocessor and may be monitored by a plurality of sensors and limit switches.

While the card handling apparatus and method of the present invention is well suited for use in the gaming environment, particularly in casinos, the apparatus and method may find use in homes, card clubs, or for handling or sorting sheet material generally.

In one preferred embodiment, the present invention provides an apparatus for moving playing cards from a first group of unshuffled cards into shuffled hands of cards, wherein at least one of said hands contains a random arrangement or selection of a preselected number of cards. The apparatus comprises a card receiver for receiving the first group of cards, a generally vertical stack of horizontally disposed card-receiving compartments generally adjacent to the card receiver, the stack generally vertically movable, an elevator for raising and lowering the stack, a card-moving mechanism between the card receiver and the stack for moving cards, one at a time, from the card receiver to a selected compartment, and a microprocessor that controls the card-moving mechanism and the elevator so that each card in the group of unshuffled cards is placed randomly into one of the compartments. Sensors monitor and trigger operation of the apparatus, including the microprocessor, card moving mechanisms, and the elevator. The controlling microprocessor, including software, randomly selects or identifies which slot or compartment will receive each card in the group before card handling operations begin. For example, a card designated as card 1 may be directed to slot 5, a card designated as card 2 may be directed to slot 7, a card designated as card 3 may be directed to slot 3, etc.

An advantage of the present invention is that it provides a programmable card handling machine with a display and appropriate inputs for adjusting the machine to any of a number of games wherein the inputs include a number of cards per hand selector, a number of hands delivered selector and a trouble-shooting input. Additionally, there may be an elevator speed adjustment and sensor to accommodate or monitor the position of the elevator as cards wear or become bowed or warped. These features also provide for interchangeability of the apparatus, meaning the same apparatus can be used for many different games and in different locations thereby reducing the number of back up machines or units required at a casino. The display may include a game mode or game selected display, and use a cycle rate and/or hand count monitor and display for determining or monitoring the usage of the machine.

Another advantage of the present invention is that it provides an electromechanical playing card handling apparatus for more rapidly generating multiple random hands of playing cards as compared to known devices. The preferred device completes a cycle in approximately 30 seconds, which is double the speed of the Breeding single deck shuffler disclosed in U.S. Pat. No. 4,807,884. Although some of the groups of playing cards (including player and dealer hands and discarded or unused cards) arranged by the apparatus in accordance with the method of the present invention may contain the same number of cards, the cards of any one group or hand are randomly selected and placed therein. Other advantages include a reduction of set up time, increased reliability, lower maintenance and repair costs, and a reduction or elimination of problems such as card counting, possible dealer manipulation and card tracking, thereby increasing the integrity of a game and enhancing casino security.

Yet another advantage of the card handling apparatus of the present invention is that it converts a single deck of unshuffled cards into a plurality of hands ready for use in playing a game. The hands are substantially completely random, i.e., the cards comprising each hand are randomly placed into that hand. To accomplish this, the preferred embodiment of the apparatus includes a number of vertically stacked, horizontally disposed card receiving compartments one above another into which cards are inserted, one at a time, until an entire group of cards is distributed. In the preferred embodiment, each compartment receiving cards is filled, regardless of the number of players participating in a particular game. For example, for a seven player game, seven player compartments, a dealer compartment and one compartment for cards not used in forming the random hands are filled. After the last card from the unshuffled group is delivered, the hands are ready to be removed from the compartments and put into play.

The preferred device of the present invention may include jammed card detection and recovery features, and may include recovery procedures operated and controlled by the microprocessor.

Generally, the operation of the card handling apparatus of the present invention will form a fixed number of hands of cards corresponding to the maximum number of players at a table, plus a dealer hand, plus a discard pile. For a typical casino table having seven player stations, the device of the present invention would preferably have nine compartments, wherein each of seven components contains the same number of cards, except the compartments for the discard and/or possibly the dealer hands. Most preferably, the device is programmed to deliver hands until the dealer presses an input button. The dealer input tells the microprocessor that the last hand has been delivered, and then the remaining cards in the compartments will be unloaded into the output or discard component. The discard or unused card hand (i.e., the cards placed in the discard compartment or slot) may contain more cards and, thus, the discard compartment may be larger than the other compartments. In a preferred embodiment, the discard compartment is located in the middle of the generally vertically arranged stack of compartments.

Another advantage is that the apparatus of the present invention provides for the initial top feeding or loading of an unshuffled group of cards thereby facilitating use by the dealer. The same is true of the hand receiving portion of the machine wherein a dealer is able to conveniently remove a randomized hand from the upper portion of the machine.

An additional advantage of the card handling apparatus of the present invention is that it facilitates and significantly speeds the play of casino wagering games, particularly those games calling for a certain, fixed number if cards per hand (e.g., Caribbean Stud®, Let It Ride®, Pai Gow Poker, stud poker games and the like), making the games more exciting for players and more profitable for casinos. The device of the present invention is believed to deliver random hands at approximately twice the speed of known devices.

In use, the apparatus of the present invention is operated to process playing cards from an initial, unshuffled or used group of cards into a plurality of hands, each hand containing the same number of randomly arranged cards. The first step of this process is the dealer placing the initial group of cards into the card receiver of the apparatus. The apparatus is started and, under the control of the integral microprocessor, assigns each card in the initial group to a compartment, based on the selected number of hands, and a selected number of cards per hand. Each hand is contained in a separate compartment of the apparatus, and each is delivered, upon the dealer's demand or automatically, by the apparatus from that compartment to a hand receiver or platform for the dealer to distribute it to a player. The number of hands created by the apparatus with each cycle are preferably selected to correspond to the maximum number of players allotted to participate in a game plus the dealer, and the number or quantity of cards per hand is programmable according to the game being played.

Each time a new group of unshuffled cards, used cards or a new deck of cards is loaded into the card receiver and the apparatus is activated, the operation of the apparatus involving that group of cards, i.e., the forming of that group of cards into hands of random cards, comprises a new cycle. Each cycle is unique and is created by the microprocessor which is programmed to include random number generating capability. The software assigns a number to the each card and then randomly selects or correlates a compartment to each number. Under the control of the microprocessor, the elevator aligns the selected compartment with the card feed mechanism in order to receive the next card. The software then directs each numbered card to the selected slots by operating the elevator motor to position that slot to receive a card.

The apparatus of the present invention is compact, easy to set up and program and, once programmed, can be maintained effectively and efficiently by minimally trained personnel who cannot affect the randomness of the card delivery. This means that the machines are more reliable in the field. Service costs are reduced, as are assembly and set up costs. The preferred device also has fewer parts which should provide greater reliability than known devices.

Other features and advantages of the present invention will become more fully apparent and understood with reference to the following specification and to the appended drawings and claims.

DETAILED DESCRIPTION

Figure 1:
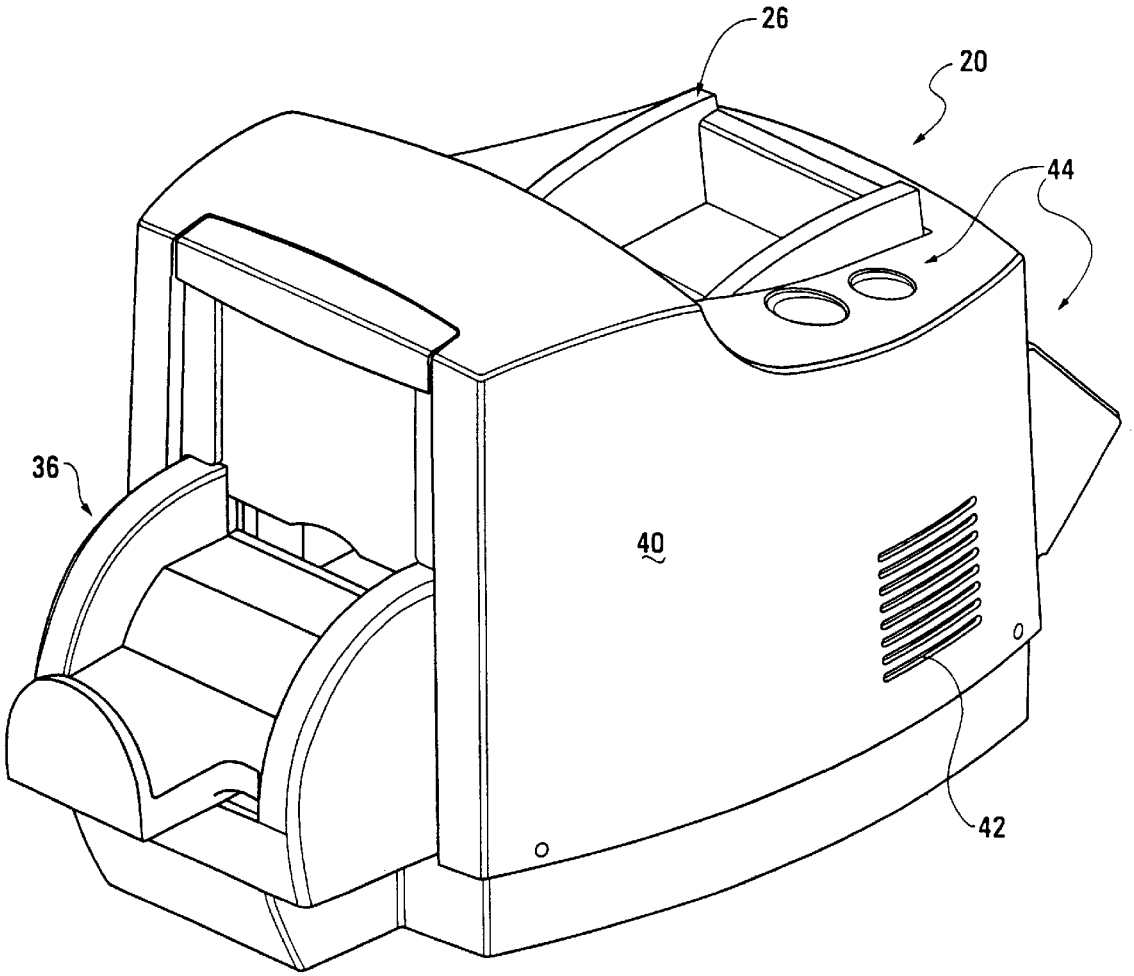
FIG. 1 is a front perspective view depicting the apparatus of the present invention as it might be disposed ready for use in a casino on a gaming table.

This detailed description is intended to be read and understood in conjunction with appended Appendices A, B and C, which are incorporated herein by reference. Appendix A provides an identification key correlating the description and abbreviation of certain motors, switches and photoeyes or sensors with reference character identifications of the same components in the Figures, and gives the manufacturers, addresses and model designations of certain components (motors, limit switches and sensors). Appendix B outlines steps in a homing sequence, part of one embodiment of the sequence of operations as outlined in Appendix C.

With regard to means for fastening, mounting, attaching or connecting the components of the present invention to form the apparatus as a whole, unless specifically described as otherwise, such means are intended to encompass conventional fasteners such as machine screws, rivets, nuts and bolts, toggles, pins and the like. Other fastening or attachment means appropriate for connecting components include adhesives, welding and soldering, the latter particularly with regard to the electrical system of the apparatus.

All components of the electrical system and wiring harness of the present invention are conventional, commercially available components unless otherwise indicated, including electrical components and circuitry, wires, fuses, soldered connections, chips, boards and control system components.

Generally, unless specifically otherwise disclosed or taught, the materials for making the various components of the present invention are selected from appropriate materials such as metal, metallic alloys, ceramics, plastics, fiberglass and the like.

In the following description, the Appendices and the claims, any references to the terms right and left, top and bottom, upper and lower and horizontal and vertical are to be read and understood with their conventional meanings and with reference to viewing the apparatus generally from the front as shown in FIG. 1.

Figure 3:
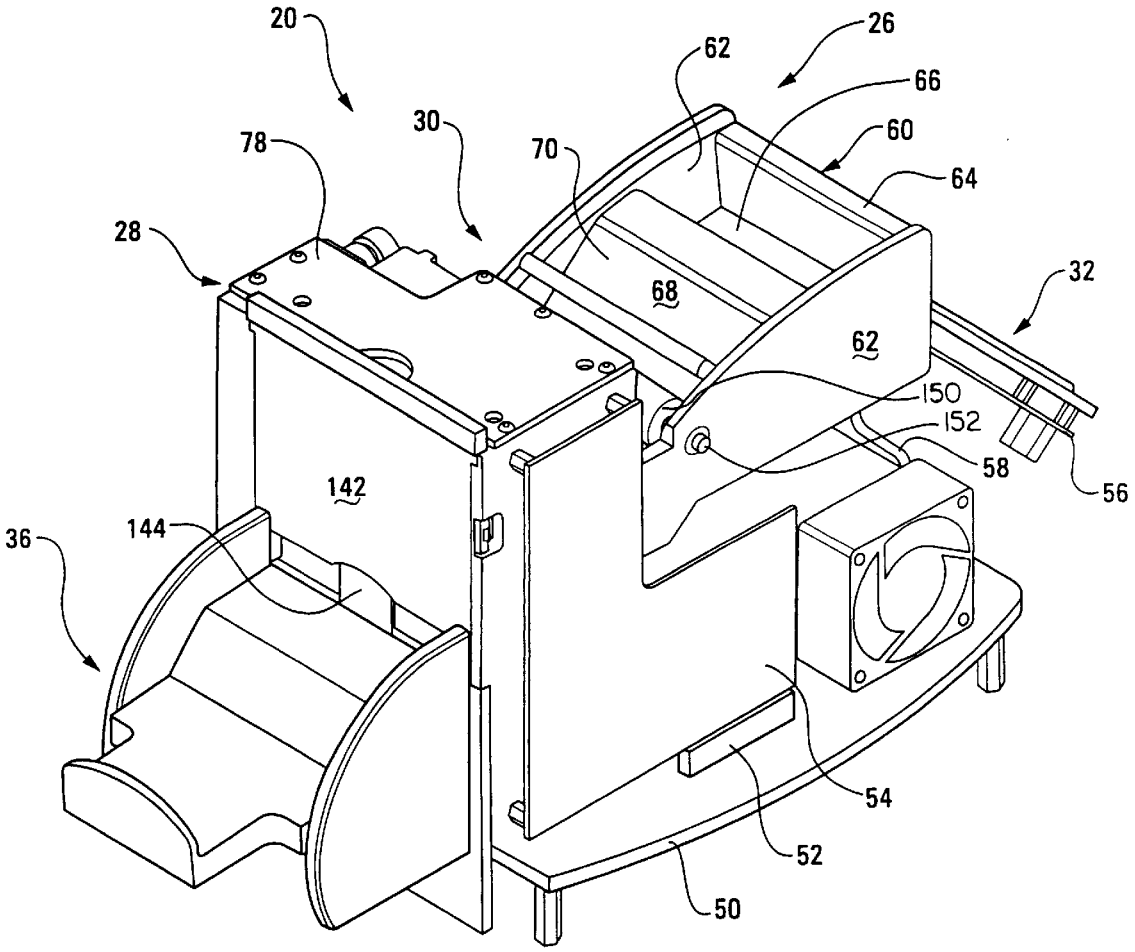
FIG. 3 is a front perspective view of the card handling apparatus of the present invention with the exterior shroud removed.
Figure 4:
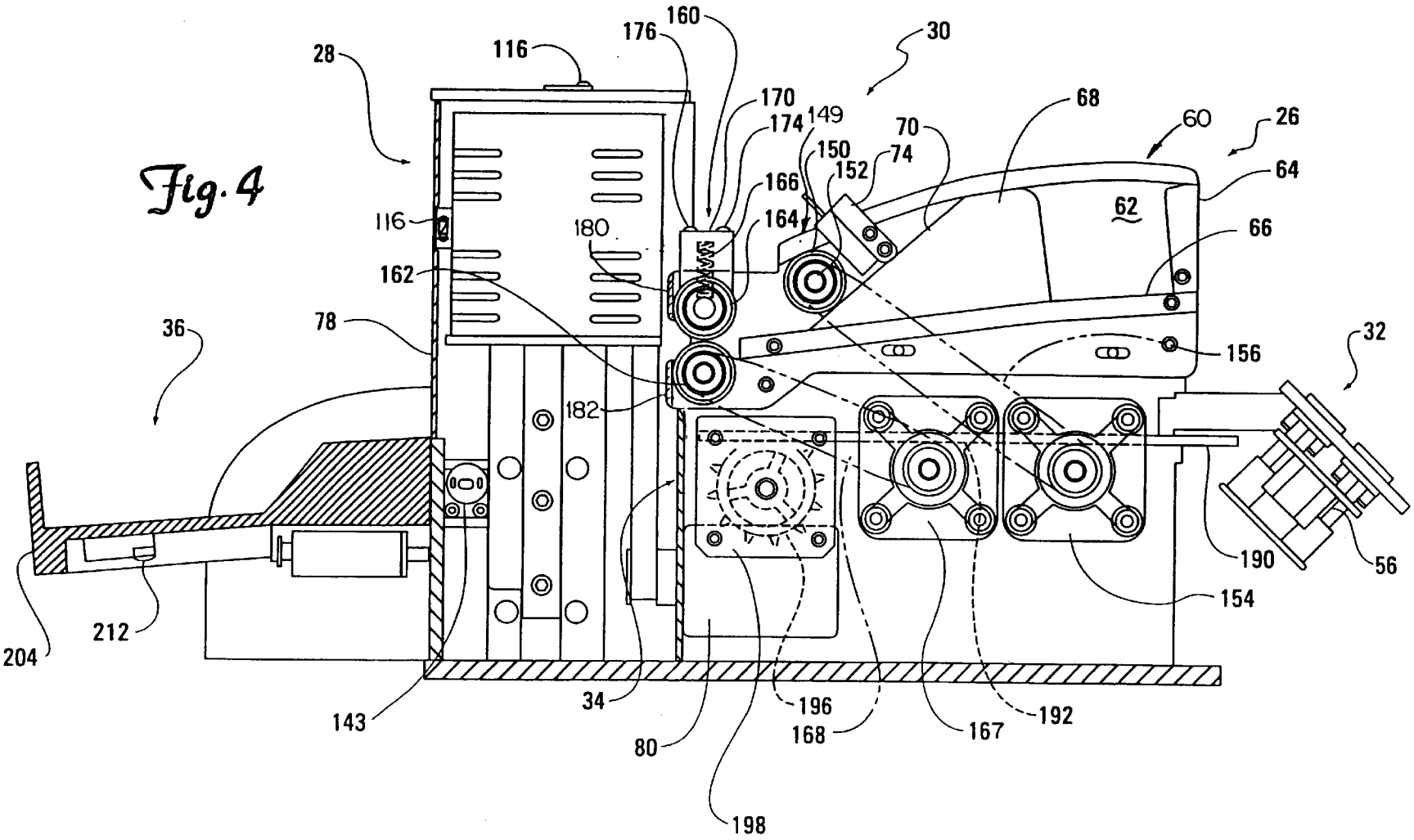
FIG. 4 is a side elevation view of the present invention with the shroud and other portions of the apparatus removed to show internal components.

Referring then to the Figures, particularly FIGS. 1, 3 and 4, the preferred card handling apparatus 20 of the present invention includes a card receiver 26 for receiving a group of cards, a single stack of card-receiving compartments 28 (see FIGS. 3 and 4) generally adjacent to the card receiver 26, a card moving or transporting mechanism 30 between and linking the card receiver 26 and the compartments 28, and a processing unit, indicated generally at 32, that controls the apparatus 20. The apparatus 20 includes a second card mover 34 (see FIG. 4) for emptying the compartments 28 into a second receiver 36.

Figure 2:
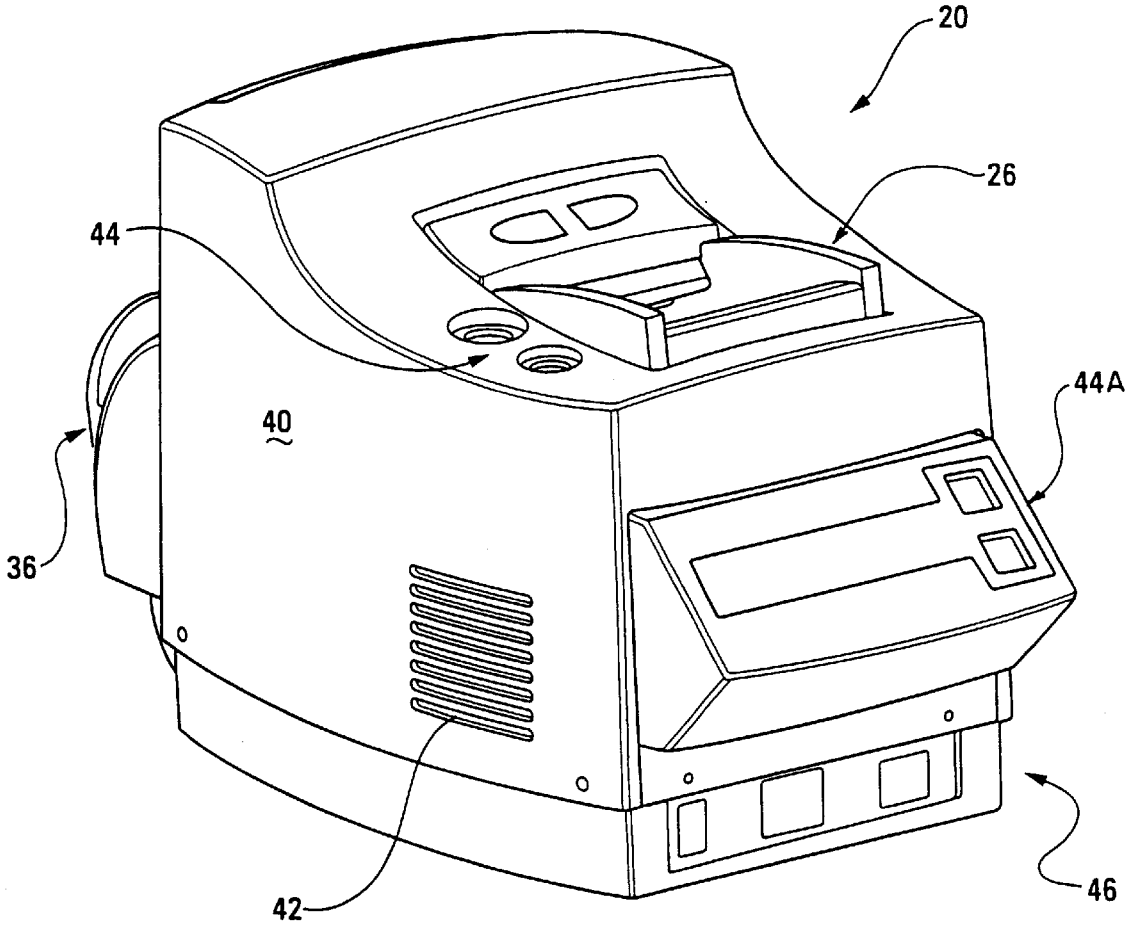
FIG. 2 is a rear perspective view depicting the apparatus of the present invention.

Referring now to FIG. 1, the card handling apparatus 20 includes a removable, substantially continuous exterior housing or shroud 40. The exterior design features of the device of the present invention are disclosed in co-pending design patent application Ser. No. 29/086,567, now issued U.S. Design Pat. No. D414,527 filed on the same date as the present application, entitled "Device for Delivering Cards." The shroud 40 may be provided with appropriate vents 42 for cooling. The card receiver or initial loading region, indicated generally at 26, is at the top, rear of the apparatus 20, and a card or hand receiving platform 36 is at the front of the apparatus 20. Controls and/or display features 44 are generally located toward the rear or dealer-facing end of the machine 20. FIG. 2 provides a perspective view of the rear of the apparatus 20 and more clearly shows the display 44A and control inputs 44, including power input module/switch and a communication port.

FIG. 3 depicts the apparatus 20 with the shroud 40 removed, as it might be for servicing or programming, whereby the internal components may be visualized. The apparatus includes a generally horizontal frame floor 50 and internal frame supports for mounting and supporting operational components, such as upright 52. A control (input and display) module 56 is cantilevered at the rear of the apparatus 20, and is operably connected to the operational portions of the apparatus 20 by suitable wiring 58. The inputs and display portion 44, 44A of the module 56 are fitted to corresponding openings in the shroud 40, with associated circuitry and programming inputs located securely within the shroud 40 when it is in place as shown in FIGS. 1 and 2.

CARD RECEIVER

The card loading region 26 includes a card receiving well 60. The well 60 is defined by upright, generally parallel card guiding side walls 62 and a rear wall 64. It includes a floor surface 66 pitched or angled downwardly toward the front of the apparatus 20. Preferably, the floor surface is pitched from horizontal at angle ranging from approximately 5 to 20 degrees, with a pitch of 7 degrees being preferred. A removable, generally rectangular weight or block 68 is generally freely movably received in the well 60 for free forward and rearward movement along the floor surface 66. Under the influence of gravity, the block 68 will tend to move toward the forward end of the well 60. The block 68 has an angled, card-contacting front face 70 for contacting the back (i.e., the bottom of the bottommost card) of a group of cards placed into the well, and urges cards (i.e., the top card of a group of cards) forward into contact with the card transporting mechanism 30. The card-contacting face 70 of the block 68 is at an angle complimentary to the floor surface 66 of the well 60, for example, an angle of between approximately 10 and 80 degrees, and this angle and the weight of the block keep the cards urged forwardly against the transport mechanism 30. The selected angle of the floor 66 and the weight of the block 68 allow for the free floating rearward movement of the cards and the block 68 to compensate for the forces generated as the transport mechanism 30 contacts the front card to move it. The well 60 includes a card present sensor 74 to sense the presence or absence of cards in the well 60. Preferably, the block 68 is mounted on a set of rollers 69 which allows the block to glide more easily along floor surface 66 and/or the floor surface 66 and floor contacting bottom of the block 68 may be formed of or coated with suitable low function materials.

CARD RECEIVING COMPARTMENTS

Figure 9:
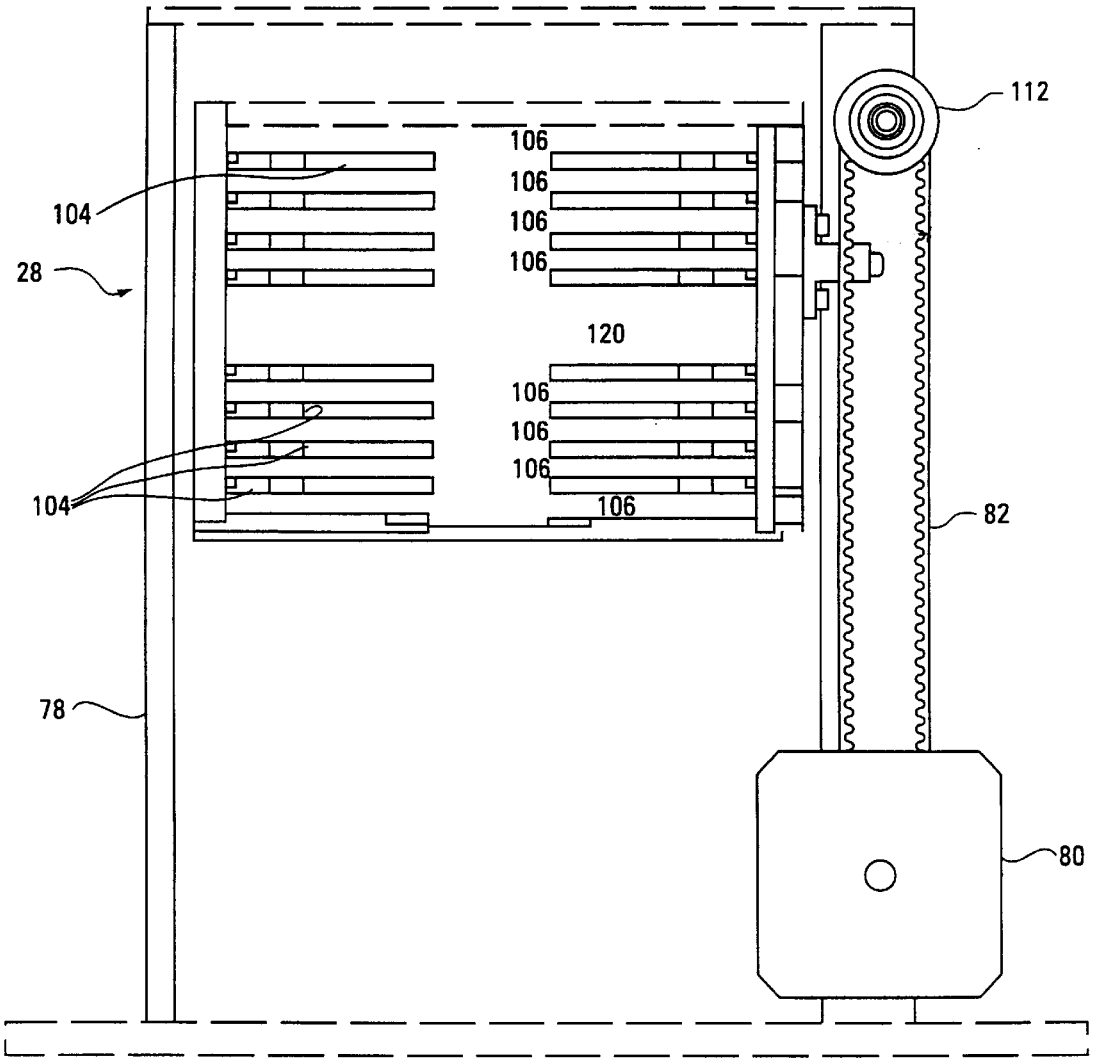
FIG. 9 is a front elevation view of the rack and elevator assembly.
Figure 10:
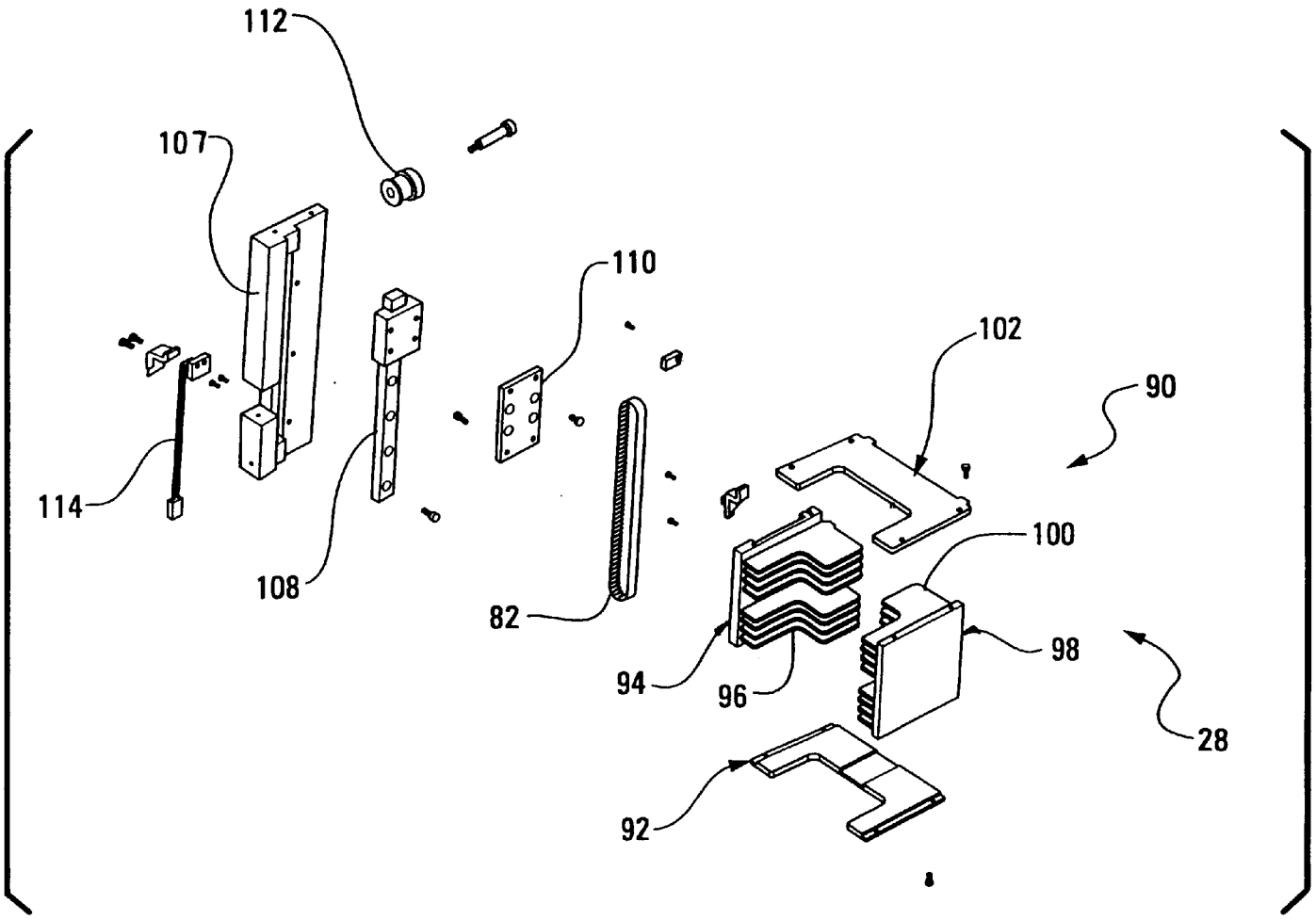
FIG. 10 is an exploded view of the rack and elevator assembly.

A preferred assembly or stack of card receiving compartments 28 is depicted in FIGS. 9 and 10, and for purposes of this disclosure is also referred to as a rack assembly. Referring back to FIG. 3, the rack assembly 28 is housed in an elevator and rack assembly housing 78 generally adjacent to the well 60, but horizontally spaced therefrom. An elevator motor 80 is provided to position the rack assembly 28 vertically under control of a microprocessor, which microprocessor is generally part of the module 32. The motor 80 is linked to the rack assembly 28 by a timing belt 82. Referring now to FIG. 10, the rack assembly 28 includes a bottom plate 92, a left hand rack 94 carrying a plurality of half shelves 96, a right hand rack 98 including a plurality of half shelves 100 and a top plate 102. Together the right and left hand racks 94, 98 and their respective half shelves 96, 100 form the individual plate-like shelf pieces 104 for forming the top and bottom walls of individual compartments 106.

Preferably, the rack assembly 28 has nine compartments 106. Seven of the nine compartments 106 are for forming player hands, one compartment 106 forms dealer hands and the last compartment 106 is for accepting unused or discard cards. It should be understood that the device the present invention is not limited to rack assembly with seven compartments 106. For example, although it is possible to achieve a random distribution of cards delivered to eight compartments with a fifty-two card deck or group of cards, if the number of cards per initial unshuffled group is greater than 52, more compartments than nine may be provided to achieve sufficient randomness in eight formed hands. Also, additional compartments may be provided to form hands for a gaming table having more than seven player positions. For example, some card rooms and casinos offer stud poker games to up to twelve people at a single table. The apparatus 20 may then have thirteen compartments, as traditional poker does not permit the house to play, with one compartment dedicated to collect unused cards.

In each example of the present invention, at least one stack of unused cards is formed which may not be sufficiently randomized for use in a card game. These unused cards should be returned to the card receiver for distribution in the next cycle.

The rack assembly 28 is operably mounted to the apparatus 20 by a left side rack plate 107 and a linear guide 108. The rack assembly 28 is attached to the guide 108 by means of a guide plate 110. The belt 82 is driven by the motor 80 and engages a pulley 112 for driving the rack assembly 28 up and down. A hall effect switch assembly 114 is provided to sense the location of the rack assembly 28. The rack assembly 28 may carry a card present sensor 116 mounted to an underside of plate 78 (see FIG. 4) and which is electrically linked to the microprocessor.

Figure 7:
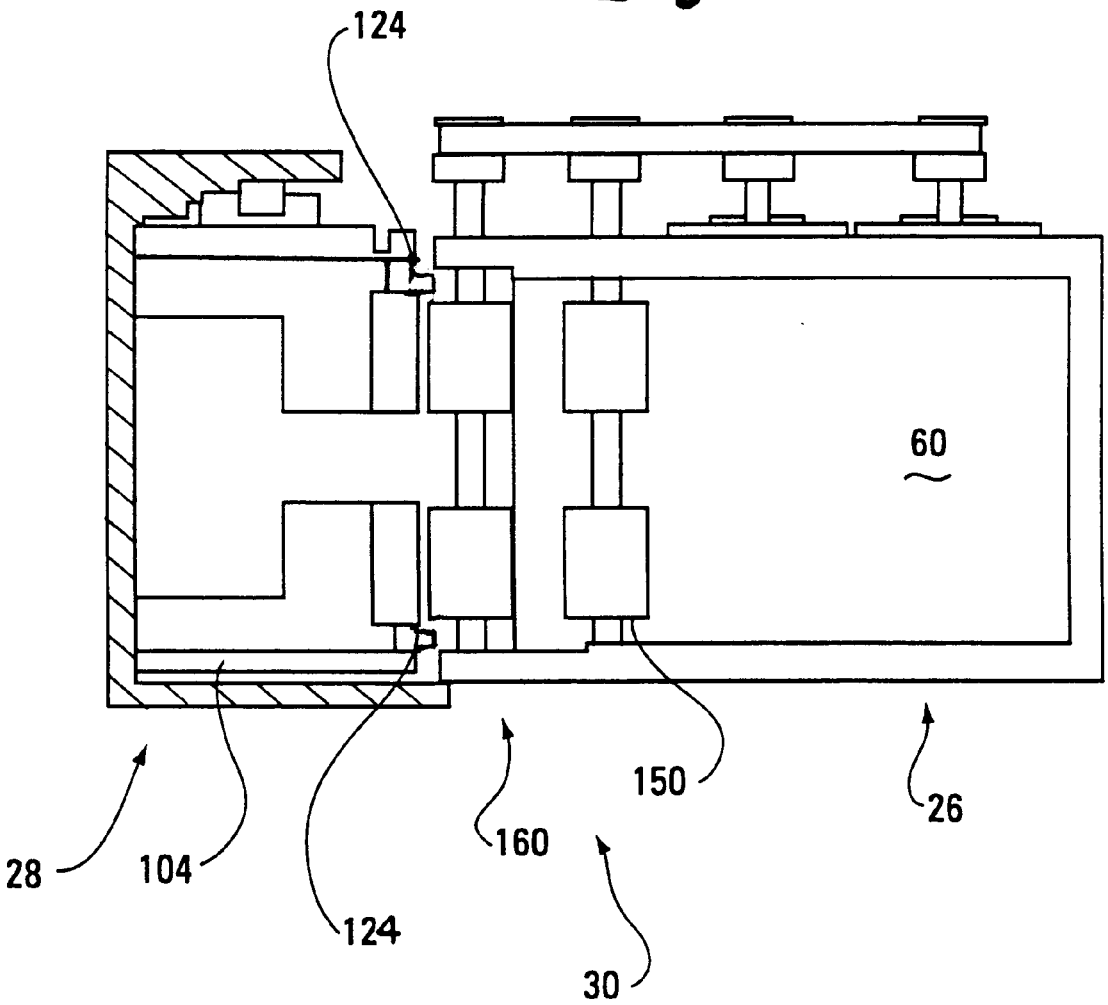
FIG. 7 is a top plan view, partially in section, of the transport mechanism.

FIG. 9 depicts a rack assembly 28 having nine individual compartments 106 including a comparatively larger central compartment 120 for receiving discard or unused cards. FIG. 7 provides a top plan view of one of the shelf members 104 and shows that each includes a pair of rear tabs 124. The tabs 124 align a leading edge of the card with an opening in the compartment so that the cards are moved from the transporting mechanism 30 into the rack assembly 28 without jamming.

Figure 11:
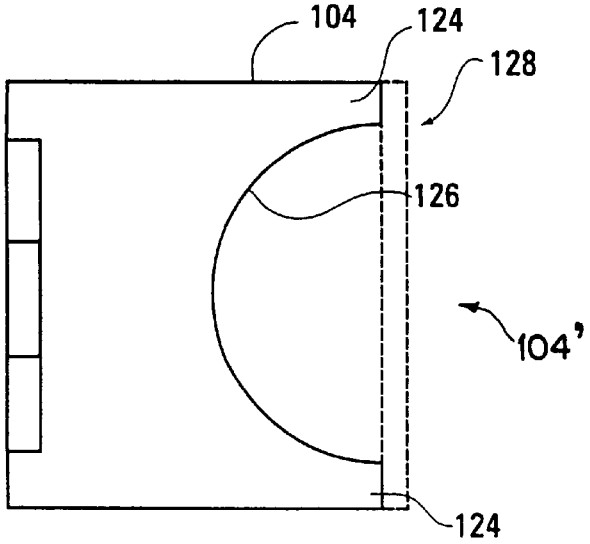
FIG. 11 depicts an alternative embodiment of the shelves or partitions for forming the stack of compartments of the present invention.

FIG. 11 depicts an alternative embodiment of plate-like shelf members 104 comprising a single-piece plate member 104'. An appropriate number of the single-piece plates, corresponding to the desired number of compartments 106 are connected between the side walls of the rack assembly 28. The plate 104' depicted in FIG. 11 includes a curved or arcuate edge portion 126 on the rear edge 128 for removing cards or clearing jammed cards, and also includes the two bilateral tabs 124, also a feature of the shelf members 104 of the rack assembly 28 depicted in FIG. 7. The tabs 124 act as card guides and permit the plate-like shelf members 104 forming the compartments 106 to be positioned effectively as closely as possible to the card transporting mechanism 30 to ensure that cards are delivered into the selected compartment 106 (or 120) even though they may be warped or bowed.

Referring back to FIG. 5, an advantage of the plates 104 (and/or the half plates 96, 100) forming the compartments 106 is depicted. Each plate 104 includes a beveled or angled underside rearmost surface 130 in the space between the shelves or plates 104, i.e., in each compartment 106, 120. The distance between the forward edge 132 of the bevel and the forward edge 134 of a shelf 104 preferably is less than the width of a typical card. As shown in FIG. 5A, the leading edge 136 of a card being driven into a compartment 106, 120 hits the beveled surface 130 and is driven the card onto the top of the stack supported by next shelf member 104. To facilitate forming a bevel 130 at a suitable angle 135 and of a suitable size, a preferred thickness 137 for the plate-like shelf members is approximately 3⁄32 of an inch, but this thickness and/or the bevel angle can be changed or varied to accommodate different sizes of cards, such as poker and bridge cards. Preferably, the bevel angle 135 is between 10 degrees and 45 degrees, and most preferably is approximately 15 degrees –20 degrees. Whatever bevel angle and thickness is selected, it is preferred that cards should come to rest with their trailing edge 133 rearward of the forward rearward edge 132 of the bevel 130.

Figure 12:
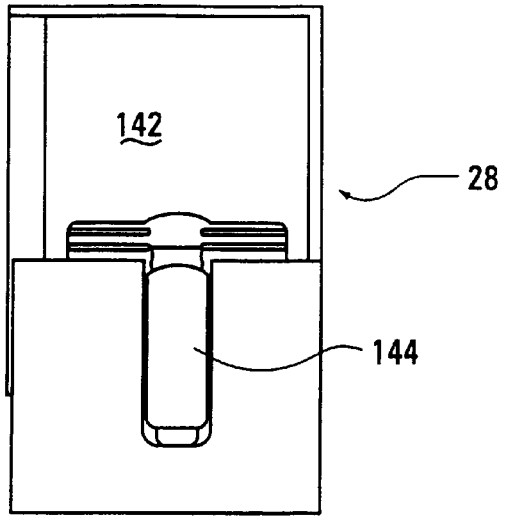
FIG. 12 depicts the card stop in an open position.
Figure 13:
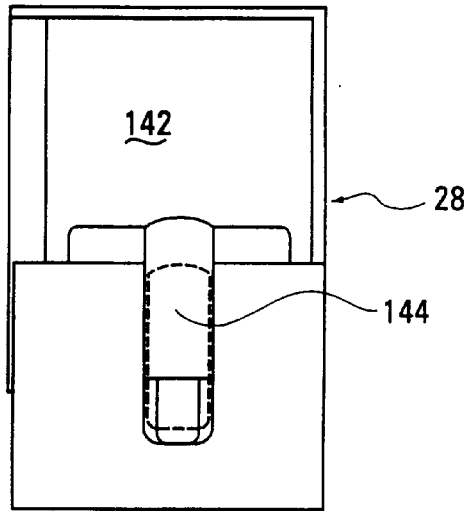
FIG. 13 depicts the card stop in a closed position.

Referring now to the FIGS. 12 and 13, the front portion of the rack assembly 28 includes a solenoid operated gate 142 and a card stop 144 for controlling the unloading of the cards into the second receiver 36. Although a separate, vertically movable gate 142 and card stop 144 are depicted, the function, stopping the forward movement of the cards, could be accomplished either by a lateral moving gate or card stop alone (not shown) or by other means. In FIG. 13, the stop 144 is shown in its raised position and FIG. 12 depicts it in its lowered open position. The position of the gate 142 and stop 144 is related by the microprocessor to the rack assembly 28 position.

CARD MOVING MECHANISM

Figure 5:
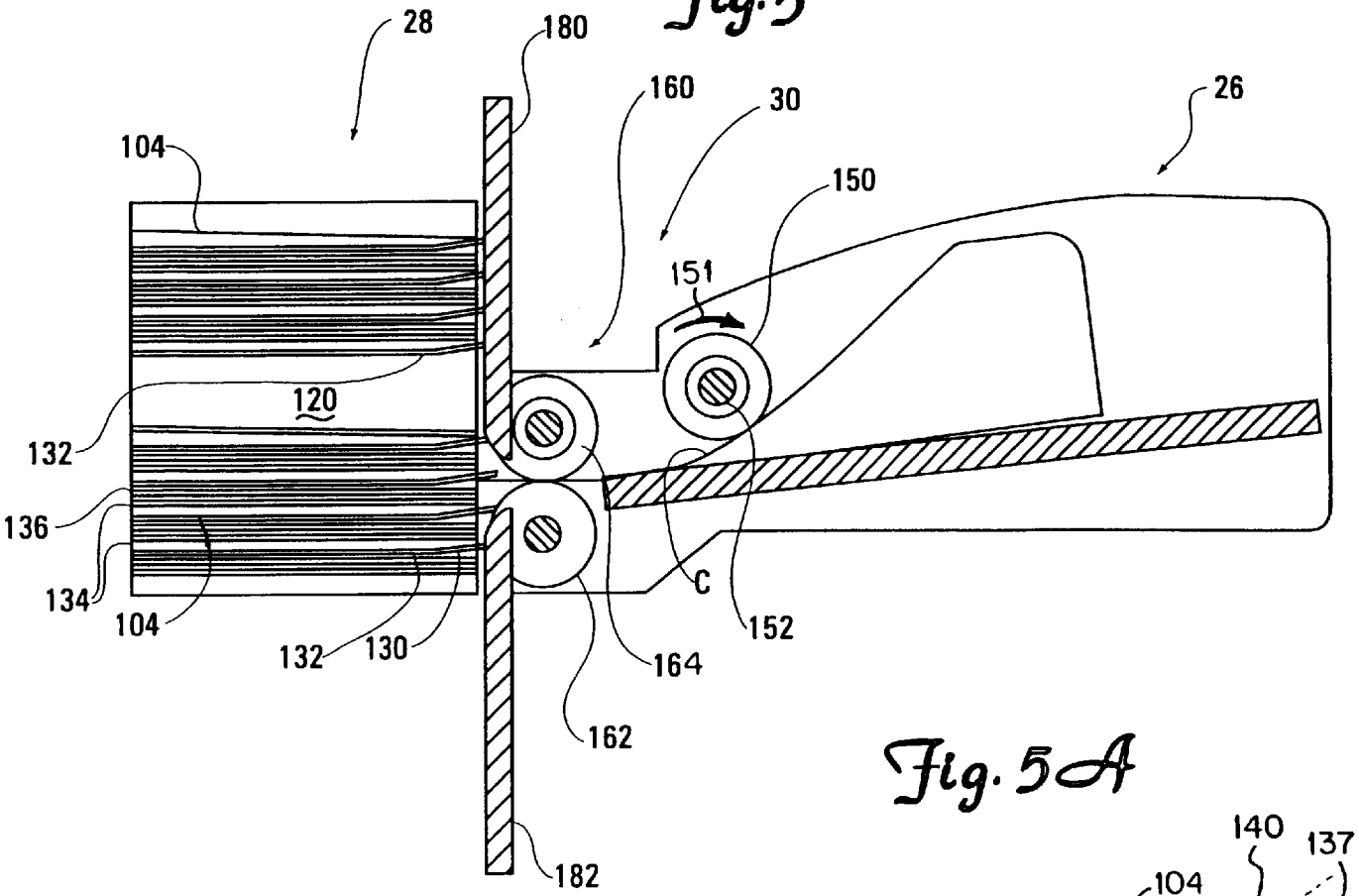
FIG. 5 is a side elevation view, largely representational, of the transport mechanism of the apparatus of the present invention.
Figure 5A:
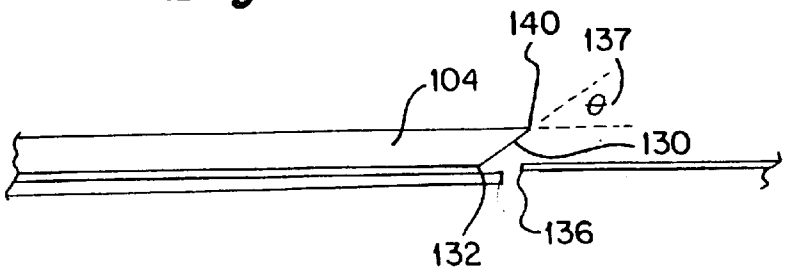
Figure 6:
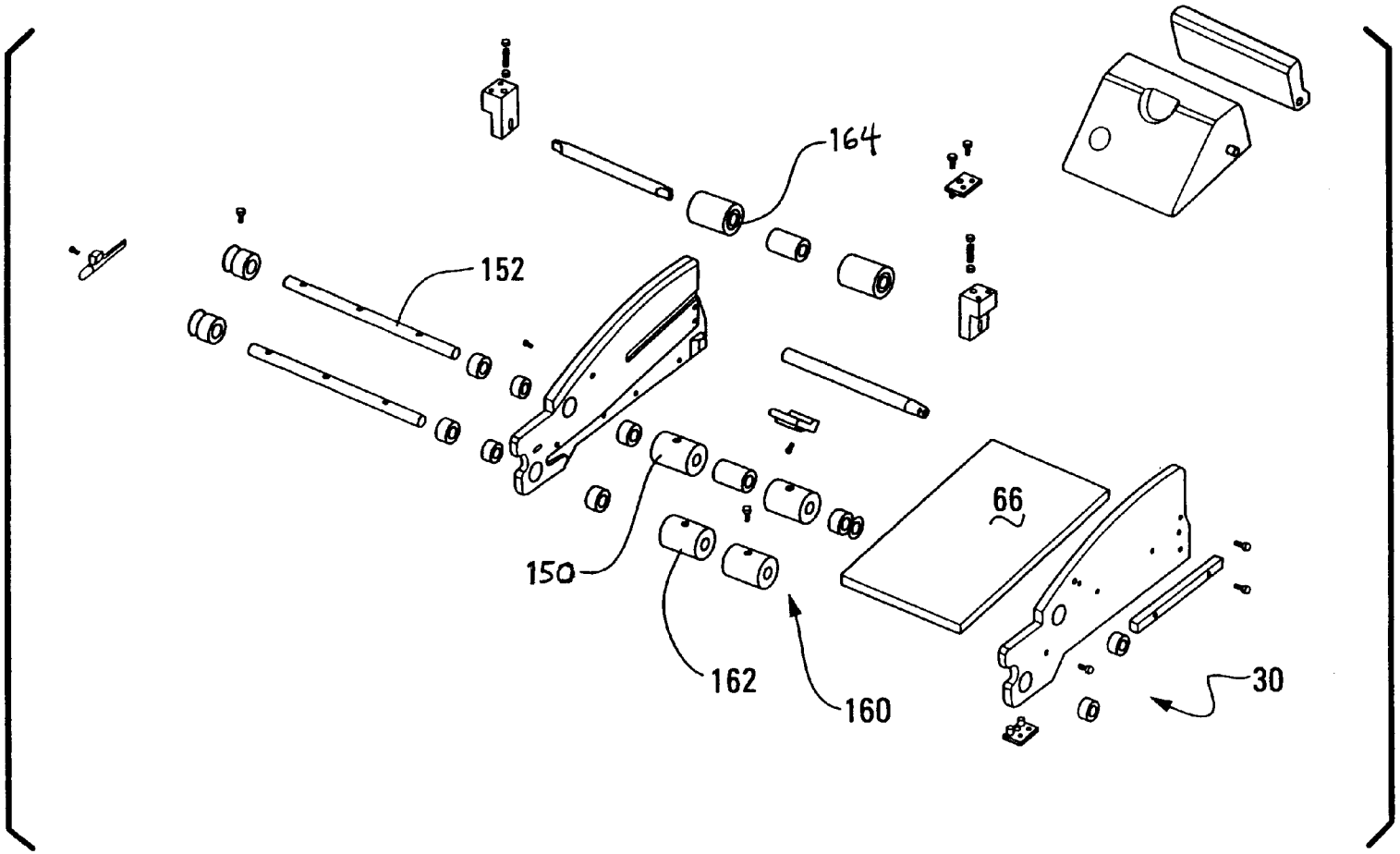
FIG. 6 is an exploded assembly view of the transport mechanism.

Referring now to FIGS. 4, 5 and 6, a preferred card transporting or moving mechanism 30 is positioned between the card receiving well 60 and the compartments 106, 120 of the rack assembly 28 and includes a card pickup roller assembly 149. The card pick-up roller assembly includes a pick-up roller 150 and is located generally at the forward portion of the well 60. The pick-up roller 150 is supported by a bearing mounted axle 152 extending generally transversely across the well 60 whereby the card contacting surface of the roller 150 is in close proximity to the forward portion of the floor surface 66. The roller 150 is driven by a pick up motor 154 operably coupled to the axle 152 by a suitable continuous connector 156 such as a belt or chain. In operation the front card in the well 60 is urged against the roller 150 by block 68 that when the roller 150 is activated, the frictional surface draws the front card downwardly and forwardly.

Referring now to FIGS. 4 and 5, the preferred card moving mechanism 30 also includes a pinch roller card accelerator or speed-up system 160 located adjacent to the front of the well 60 between the well 60 and the rack assembly 28 and forwardly of the pick-up roller 150. The speed-up system 160 comprises a pair of axle supported, closely adjacent speed-up rollers, one above the other, including a lower roller 162 and an upper roller 164. The upper idling roller 164 is urged toward the lower roller 162 by a spring assembly 166. Alternatively, it may be weighted or drawn toward the lower roller by a resilient member (not shown). The lower roller 162 is driven by a speed-up motor 167 operably linked to the lower driven roller 162 by a suitable connector 168 such as a belt or a chain. The mounting bracket 170 for the speed-up rollers also supports a rearward card-in sensor 174 and a forward card-out sensor 176. FIG. 5 is a largely representational view depicting the relationship between the card receiving well 60 and the card transporting mechanism 30, and also shows a card "C" being picked up by the pick-up roller 150 moving in rotational direction 151 and being moved into the pinch roller system 160 for acceleration into a compartment 104 of the rack assembly 28.

In the preferred embodiment, the pick-up roller 150 is not continuously driven, but rather indexes and includes a one-way clutch mechanism. After initially picking up a card and advancing it into the pinch roller system 160, the motor 154 operably coupled to the pick-up roller 150 stops driving the roller, and the roller 150 free-wheels as the card is accelerated through the pinch roller system 160. The speed-up pinch roller system 160 is preferably continuous in operation once a hand-forming cycle starts and, when a card is sensed by the adjacent card out sensor 176, the pick-up roller 150 stops and free-wheels while the card is accelerated through the pinch roller system 160. When the trailing edge of the card is sensed by the card out sensor 176, the rack assembly 28 moves to the next position for the next card and the pick-up roller 150 is re-activated.

Additional components and details of the transport mechanism 30 are depicted in FIG. 6, an exploded assembly view thereof. In FIG. 6 the inclined floor surface 66 of the well 60 is visible, as are the axle mounted pickup and pinch roller system 150, 160, respectively, and their relative positions.

Referring to FIGS. 4 and 5, the transport assembly 30 includes a pair of generally rigid stopping plates including an upper stop plate and a lower stop plate, 180, 182, respectively. The plates 180, 182 are positioned between the rack assembly 28 and the speed-up system 160 immediately forward of and above and below the pinch rollers 162, 164. The stop plates 180, 182 stop the cards from rebounding or bouncing rearwardly, back toward the pinch rollers, as they are driven against and contact the gate 142 and/or the stop 144 at the front of the rack assembly 28.

PROCESSING/CONTROL UNIT

Figure 16:
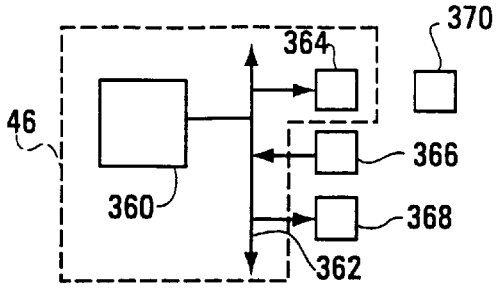
FIG. 16 is a schematic diagram of an electrical control system for one embodiment of the present invention.

FIG. 16 is a block diagram depicting an electrical control system which may be used in one embodiment of the present invention. The control system includes a controller 360, a bus 362, and a motor controller 364. Also represented in FIG. 16 are inputs 366, outputs 368, and a motor system 370. The controller 360 sends signals to both the motor controller 364 and the outputs 368 while monitoring the inputs 366. The motor controller 364 interprets signals received over the bus 362 from the controller 360. The motor system 370 is driven by the motor controller 364 in response to the commands from the controller 360. The controller 360 controls the state of the outputs 368 and the state of the motor controller 364 by sending appropriate signals over the bus 362.

In a preferred embodiment of the present invention, the motor system 370 comprises motors that are used for operating components of the card handling apparatus 20. Motors operate the pick-up roller, the pinch, speed-up rollers, the pusher and the elevator. The gate and stop may be operated by a motor, as well. In such an embodiment, the motor controller 364 would normally comprise one or two controllers and driver devices for each of the motor used. However, other configurations are possible.

The outputs 368 include, for example, alarm, start, and reset indicators and inputs and may also include signals that can be used to drive a display device (e.g., a LED display—not shown). Such a display device can be used to implement a timer, a card counter, or a cycle counter. Generally, an appropriate display device can be configured and used to display any information worthy of display.

The inputs 366 are information from the limit switches and sensors described above. The controller 360 receives the inputs 366 over the bus 362.

Figure 17:
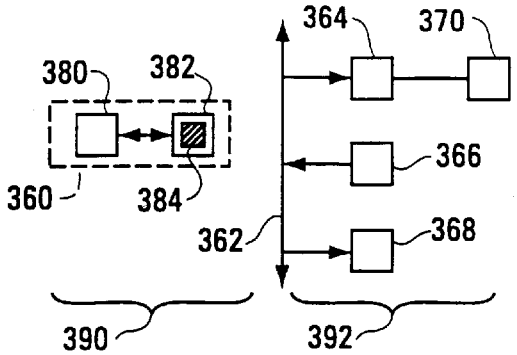
FIG. 17 is a schematic diagram of the electrical control system.

Although the controller 360 can be any digital controller or microprocessor-based system, in a preferred embodiment, the controller 360 comprises a processing unit 380 and a peripheral device 382 as shown in FIG. 17. The processing unit 380 in a preferred embodiment may be an 8-bit single-chip microcomputer such as an 80C52 manufactured by the Intel Corporation of Santa Clara, Calif. The peripheral device 382 may be a field programmable micro controller peripheral device that includes programmable logic devices, EPROMs, and input-output ports. As shown in FIG. 17, peripheral device 382 serves as an interface between the processing unit 380 and the bus 362.

The series of instructions are stored in the controller 360 as shown in FIG. 17 as program logic 384. In a preferred embodiment, the program logic 384 is RAM or ROM hardware in the peripheral device 382. (Since the processing unit 380 may have some memory capacity, it is possible that some of the instructions may be stored in the processing unit 380.) As one skilled in the art will recognize, various implementations of the program logic 384 are possible. The program logic 384 could be either hardware, software, or a combination of both. Hardware implementations might involve hardwired code or instructions stored in a ROM or RAM device. Software implementations would involve instructions stored on a magnetic, optical, or other media that can be accessed by the processing unit 380.

Under certain conditions, it is possible that a significant amount of electrostatic charge may build up in the card handler 20. Significant electrostatic discharge could affect the operation of the handler 20. It is preferable to isolate some of the circuitry of the control system from the rest of the machine. In a preferred embodiment of the present invention, a number of optically-coupled isolators are used to act as a barrier to electrostatic discharge.

Figure 18:
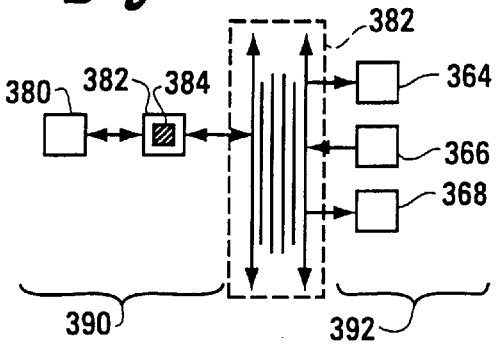
FIG. 18 is a schematic diagram of an electrical control system with an optically-isolated bus.
Figure 19:
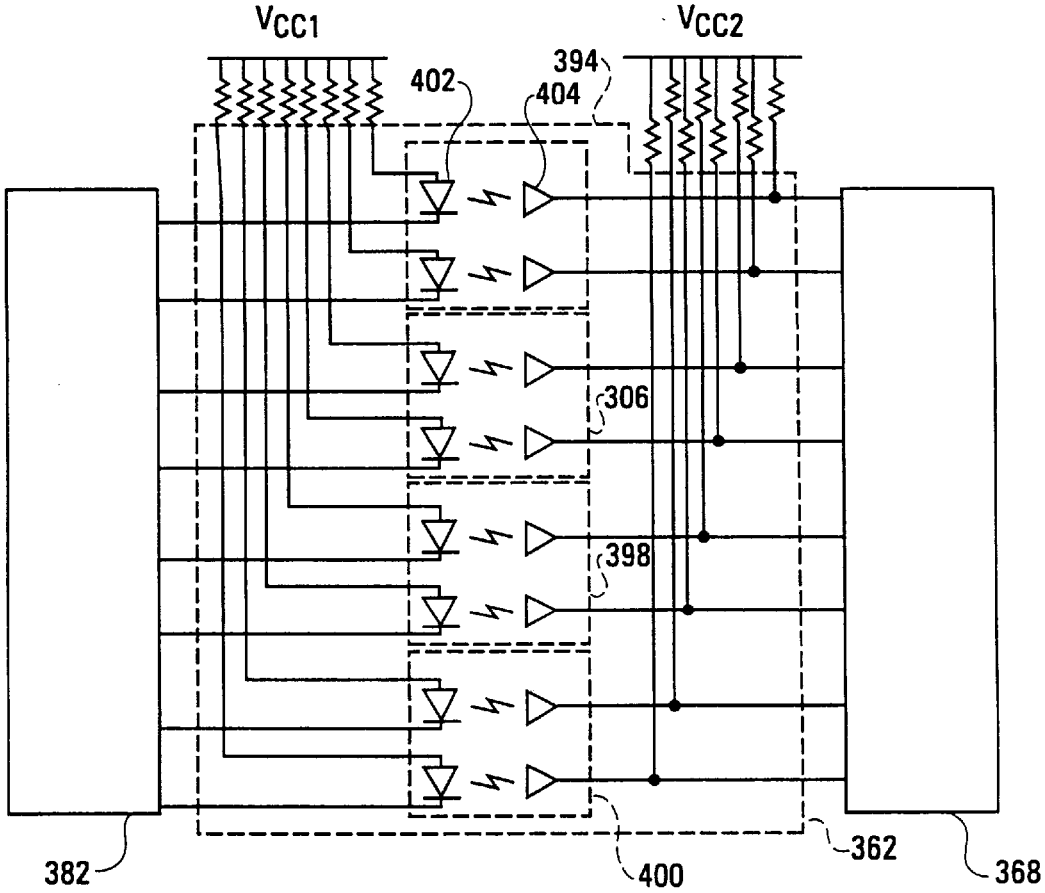
FIG. 19 is a detailed schematic diagram of a portion of the control system illustrated in FIG. 18.

As shown in FIG. 18, a first group of circuitry 390 can be electrically isolated from a second group of circuitry 392 by using optically-coupled logic gates that have light-emitting diodes to optically (rather than electrically) transmit a digital signal, and photo detectors to receive the optically transmitted data. An illustration of electrical isolation through the use of optically-coupled logic gates is shown in FIG. 19, which shows a portion of FIG. 18 in greater detail. Four Hewlett-Packard HCPL-2630 optocouplers (labeled 394, 396, 398 and 400) are used to provide an 8-bit isolated data path to the output devices 368. Each bit of data is represented by both an LED 402 and a photo detector 404. The LEDs emit light when energized and the photo detectors detect the presence or absence of the light. Data may thus transmitted without an electrical connection.

SECOND CARD MOVING MECHANISM

Figure 8:
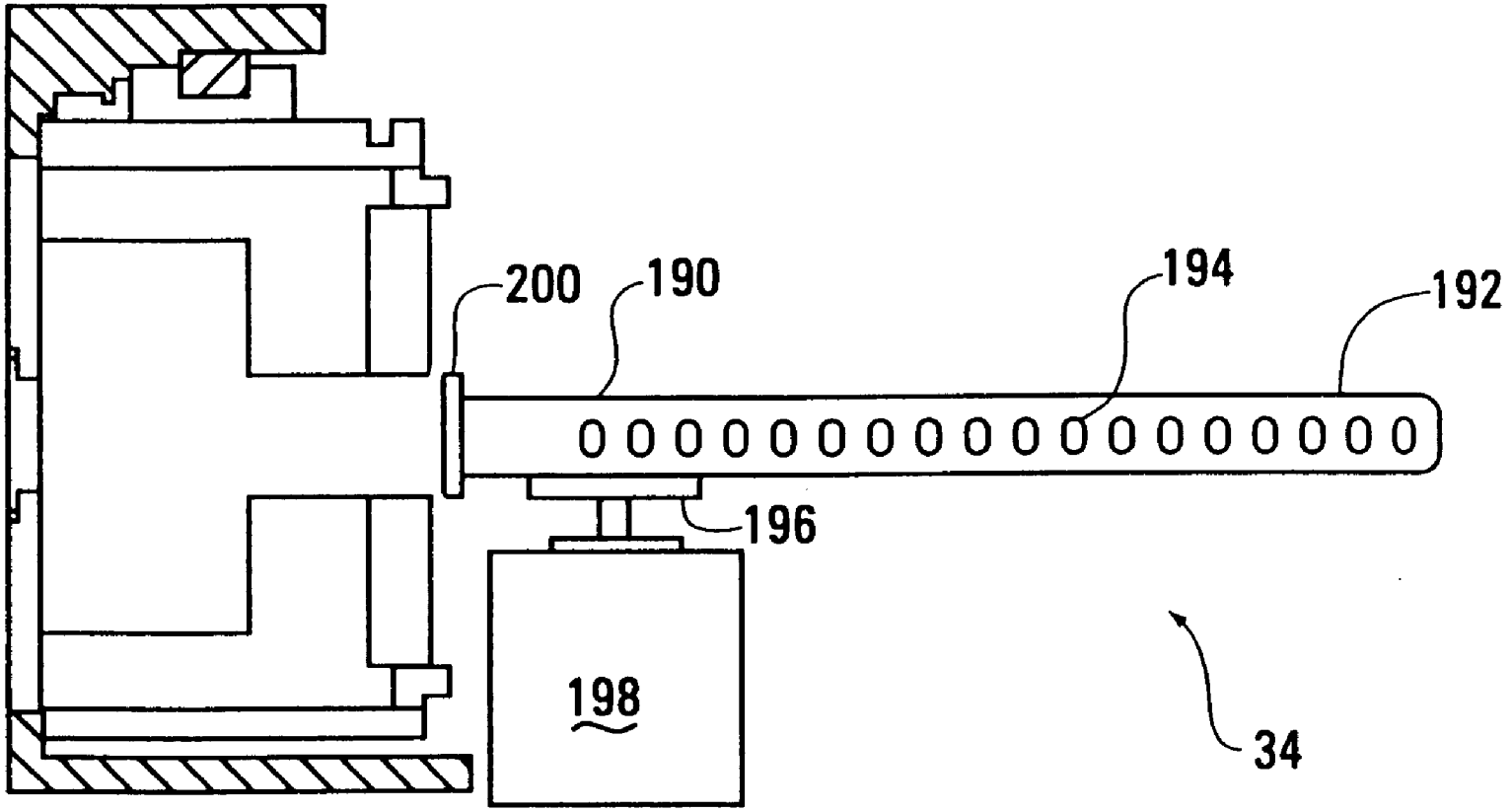
FIG. 8 is a top plan view of the pusher assembly of the present invention.

Referring to FIGS. 4 and 8, the apparatus 20 includes a second card moving mechanism 34 comprising a reciprocating card compartment unloading pusher 190. The pusher 190 includes a substantially rigid pusher arm 192 in the form of a rack having a plurality of linearly arranged apertures 194 along its length. The arm 192 operably engages the teeth of a pinion gear 196 driven by an unloading motor 198, which is in turn controlled by the microprocessor 360. At its leading or card contacting end, the pusher arm 192 includes a blunt, enlarged card-contacting end portion 200. The end portion 200 is greater in height than the space between the shelf members 104 forming the compartments 106 to make sure that all the cards (i.e., the hand) contained in a selected compartment are contacted and pushed out as it is operated, even when the cards are bowed or warped. The second card moving mechanism 34 is operated intermittently (upon demand or automatically) to empty full compartments 106 at or near the end of a cycle.

SECOND CARD/HAND RECEIVER

When actuated, the second card moving mechanism 34 empties a compartment 106, 120 by pushing the group of cards therein into a card receiving platform 36. The card receiving platform 36 is shown in FIGS. 1, 4, 14 and 16, among others.

Figure 15:
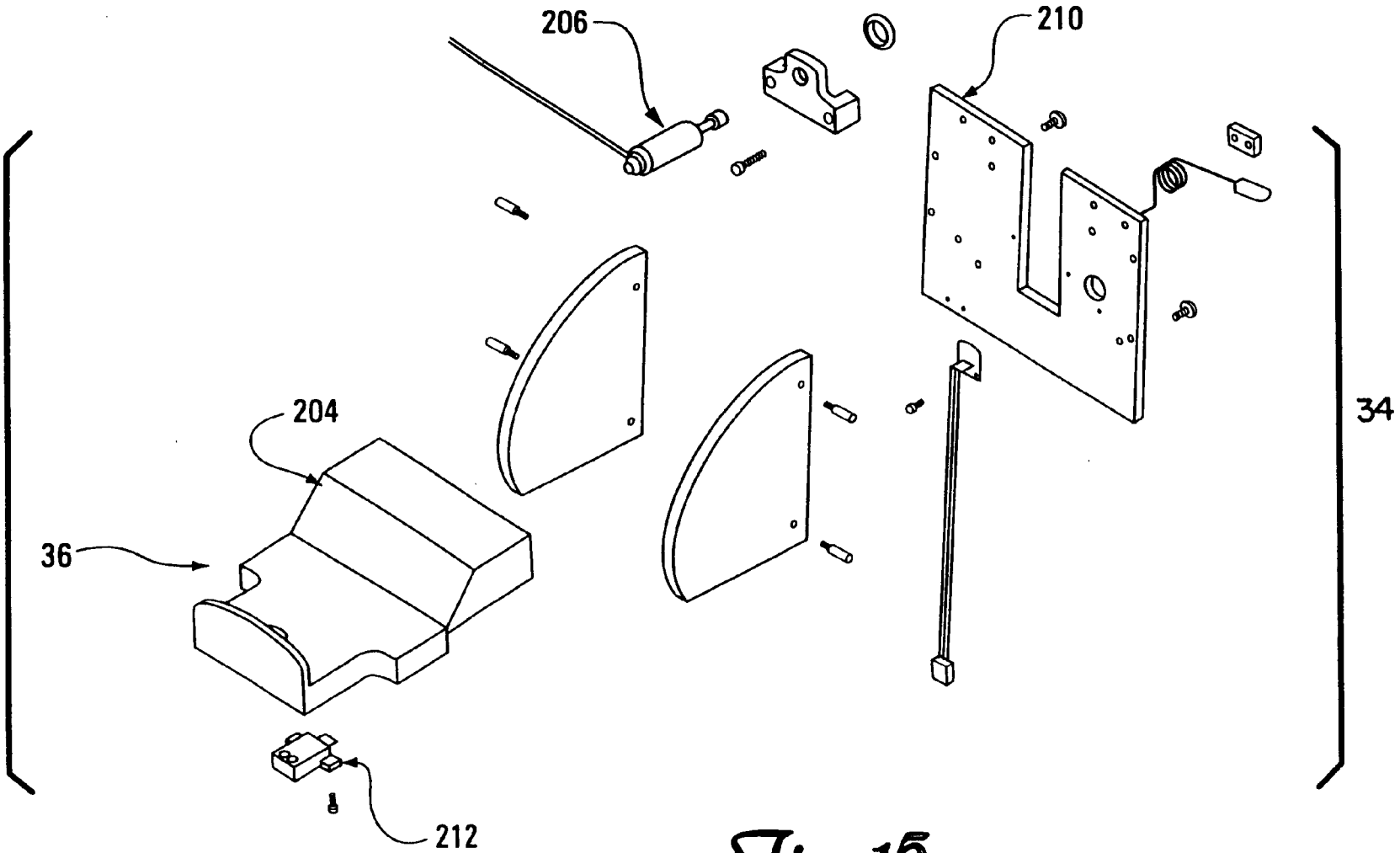
FIG. 15 is an exploded view of the hand receiving assembly of the apparatus of the present invention.

Referring to FIG. 15, the second card or hand receiving platform 36 includes a shoe plate 204 and a solenoid assembly 206, including a solenoid plate 208, carried by a rear plate 210, which is also the front plate of the rack assembly 28. The shoe plate 204 also carries an optical sensing switch 212 for sensing the presence or absence of a hand of cards and for triggering the microprocessor to drop the gate 142 and actuate the pusher 190 of the second transport assembly 34 to unload another hand of cards from a compartment 106, 120 when the hand receiver 36 is empty. In a first preferred embodiment, the player hands are unloaded sequentially. After the dealer receives his hand, he or she presses a button which instructs any remaining hands and the discard pile to unload. According to a second preferred embodiment, the microprocessor is programmed to randomly select and unload all player hands, then the dealer hand, and last the discard pile.

Figure 14:
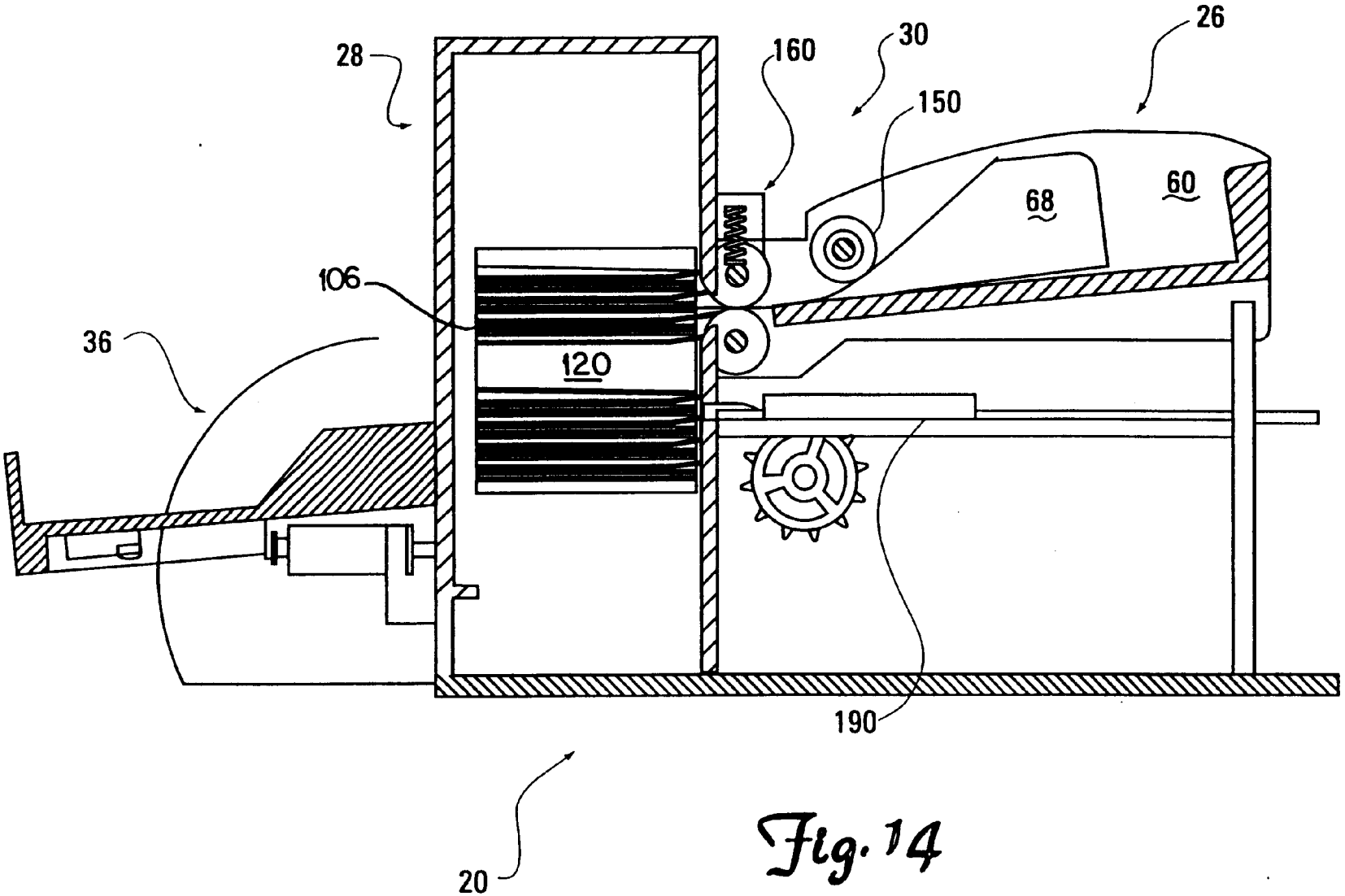
FIG. 14 is a simplified side elevation view, largely representational, of the card handler of the present invention.

FIG. 14 is a largely representational view depicting the apparatus 20 and the relationship of its components including the card receiver 26 for receiving a group of cards for being formed into hands, including the well 60 and block 68, the rack assembly 28 and its single stack of card-receiving compartments 106, 120, the card moving or transporting mechanism 30 between and linking the card receiver 26 and the rack assembly 28, the second card mover 190 for emptying the compartments 106, 120, and the second receiver 36 for receiving hands of cards.

ALTERNATIVE EMBODIMENTS

Figure 20:
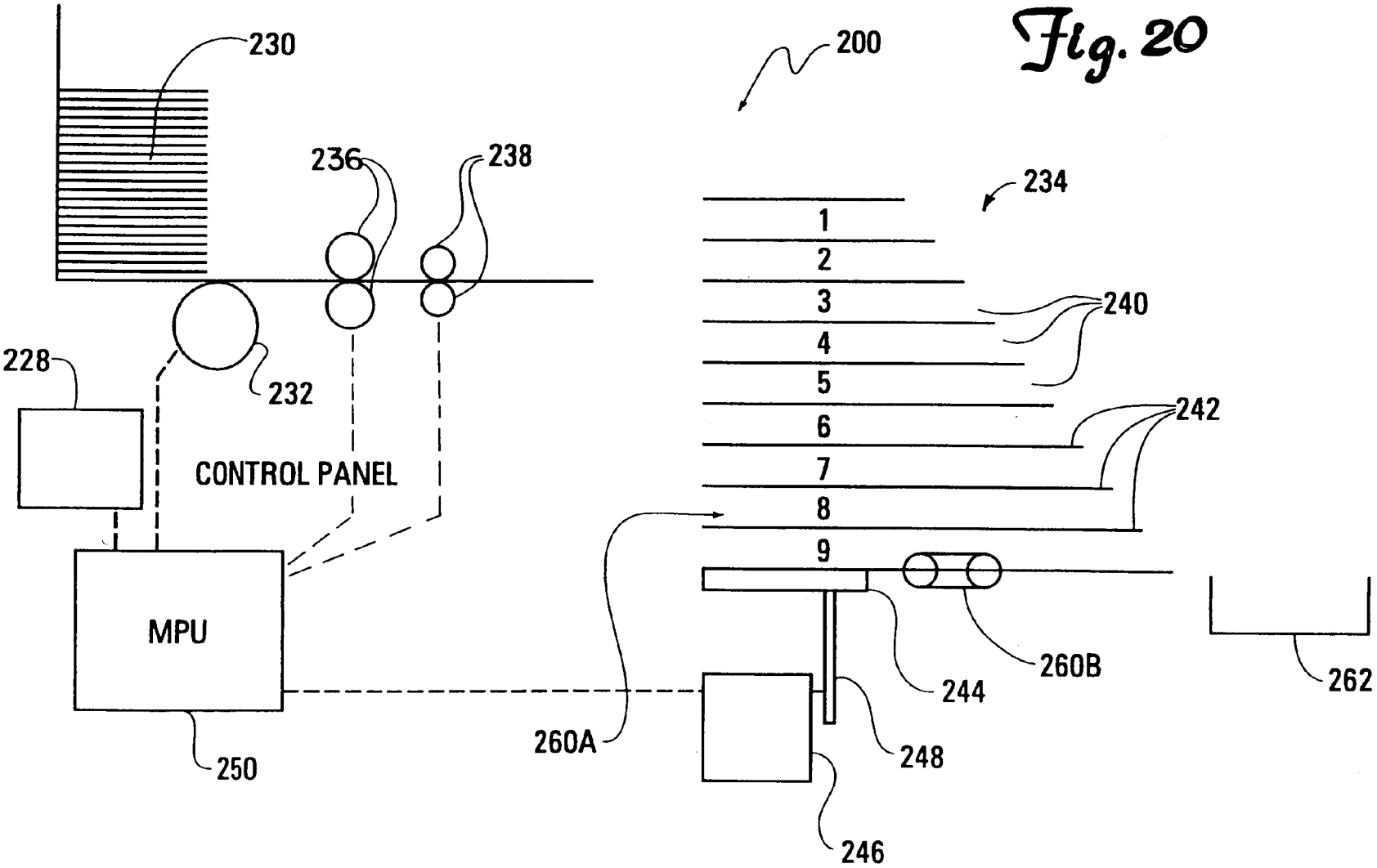
FIG. 20 schematically depicts an alternative embodiment of the apparatus of the present invention.

FIG. 20 represents an alternative embodiment of the present invention wherein the card handler 200 includes an initial staging area 230 for receiving a vertically stacked deck or group of unshuffled cards. Preferably beneath the stack is a card extractor 232 which picks up a single card and moves it toward a grouping device 234. The picked up card moves through a card separator 236, which is provided in case more than one card is picked up, and then through a card accelerator 238. The grouping device 234 includes a plurality of compartments 240 defined, in part, by a plurality of generally horizontally disposed, parallel shelf members 242. In one embodiment there are two more compartments than player positions at the table at which the device is being used. In one preferred embodiment the grouping device 34 includes nine compartments (labeled 1–9), seven of which correspond to the player positions, one which corresponds to the dealer's position and the last for discards. The grouping device is supported by a generally vertically movable elevator 244, the height of which is controlled by a stepper motor 246, linked by means of a belt drive 248 to the elevator 244. A microprocessor 250 randomly selects the location of the stepper motor and instructs the stepper motor to move the elevator 244 to that position. The microprocessor 250 is programmed to deliver a predetermined number of cards to each compartment 240. After the predetermined number of cards is delivered to a compartment 240, no additional cards will be delivered there.

Each time a group of unshuffled cards are handled by this embodiment of the present invention, the order in which the cards are delivered to the compartments 240 is different due to the use of a random number generator to determine which compartment receives each card in the group. Making hands of cards in this particular fashion serves to randomize the cards to an extent sufficient to eliminate the need to shuffle the entire deck prior to forming hands.

A feature of the embodiment of the present invention depicted in FIG. 20 is a card pusher or rake 260A. The rake 260A may be either an arm with a head which pushes horizontally from the trailing edge of a card or group of cards, or a roller and belt arrangement 260B which propels a card or group of cards by providing frictional contact between one or more rollers and a lower surface of a card or the bottom-most card. The purpose of the rake 260A is to move the cards toward an open end of the elevator. In this embodiment of the invention, the compartments are staggered so that if the card rake 260A only pushes the dealt cards a portion of the way out the dealer can still lift out each hand of cards and deliver the hand to a player. The rake 260A can also be set to push a hand of cards completely out of a compartment whereby the cards fall onto a platform 262. The hand delivered to platform 262 may be then removed and handed to the player. A sensor may be provided adjacent to the platform 262 whereby an empty platform is sensed so that the rake 260A pushes or propels another hand of cards onto the platform 262.

In another embodiment the microprocessor 250 is programmed so that the card rake 260A moves the cards to a point accessible to the dealer and then, upon optional activation of a dealer control input, pushes the cards out of the compartment 240 onto the receiver 262.

In a preferred embodiment of the embodiment depicted in FIG. 20, although the microprocessor 250 can be programmed to deliver a different number of cards to the dealer compartment than to the player compartments, it is contemplated that the microprocessor will cause the apparatus to deliver the same number of cards to each compartment. The dealer, however, may discard cards until he or she arrives at the desired number of dealer cards for the particular game being played. For example, for the poker game known as the LET IT RIDE® game, the players and dealer initially receive a three card hand. The dealer then discards or "burns" one of his cards and plays with the remaining two cards.

With continued reference to FIG. 20, nine card compartments or slots are depicted. The card extractor/separator combination delivers a selected number of player cards into each of the compartments labeled 1–7. Preferably, the same number of dealer's cards may be delivered into compartment 8. Alternatively, the microprocessor 250 can be programmed so that slot 8 will receive more than or fewer than the same number of cards as the players' compartments 1–7. In the embodiment depicted in FIG. 20, card receiving compartment 9, which may be larger than the others, receives all extra cards from a deck. Preferably, the MPV instructs the device 200 to form only the maximum number of player hands plus a dealer hand. The number of cards delivered to each position may depend upon the game and the number of cards required.

OPERATION/ USE

Figure 21A:
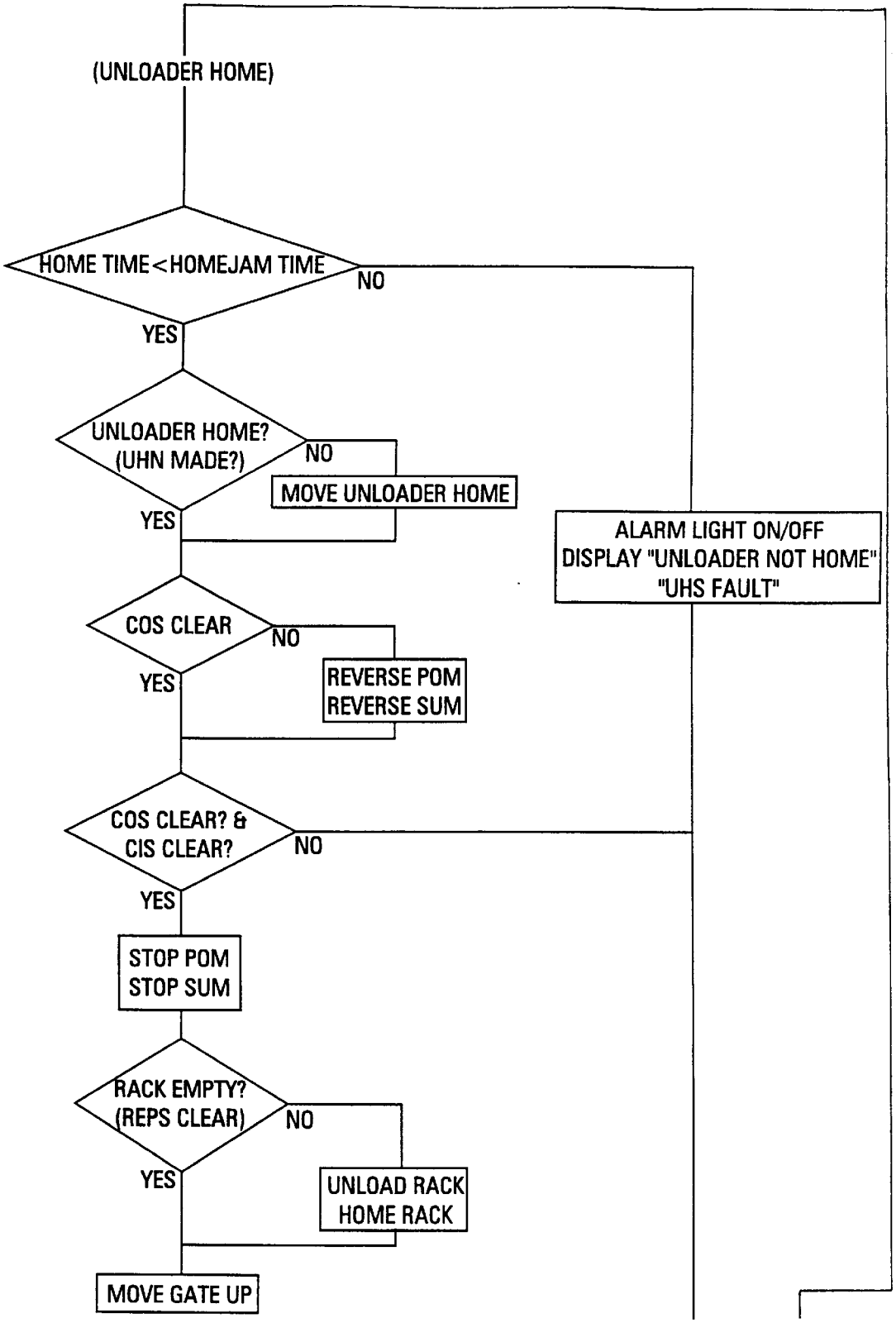
FIG. 21 is a flow diagram, comprising two parts, parts 21*a* and 21*b*, depicting a homing sequence.
Figure 21B:
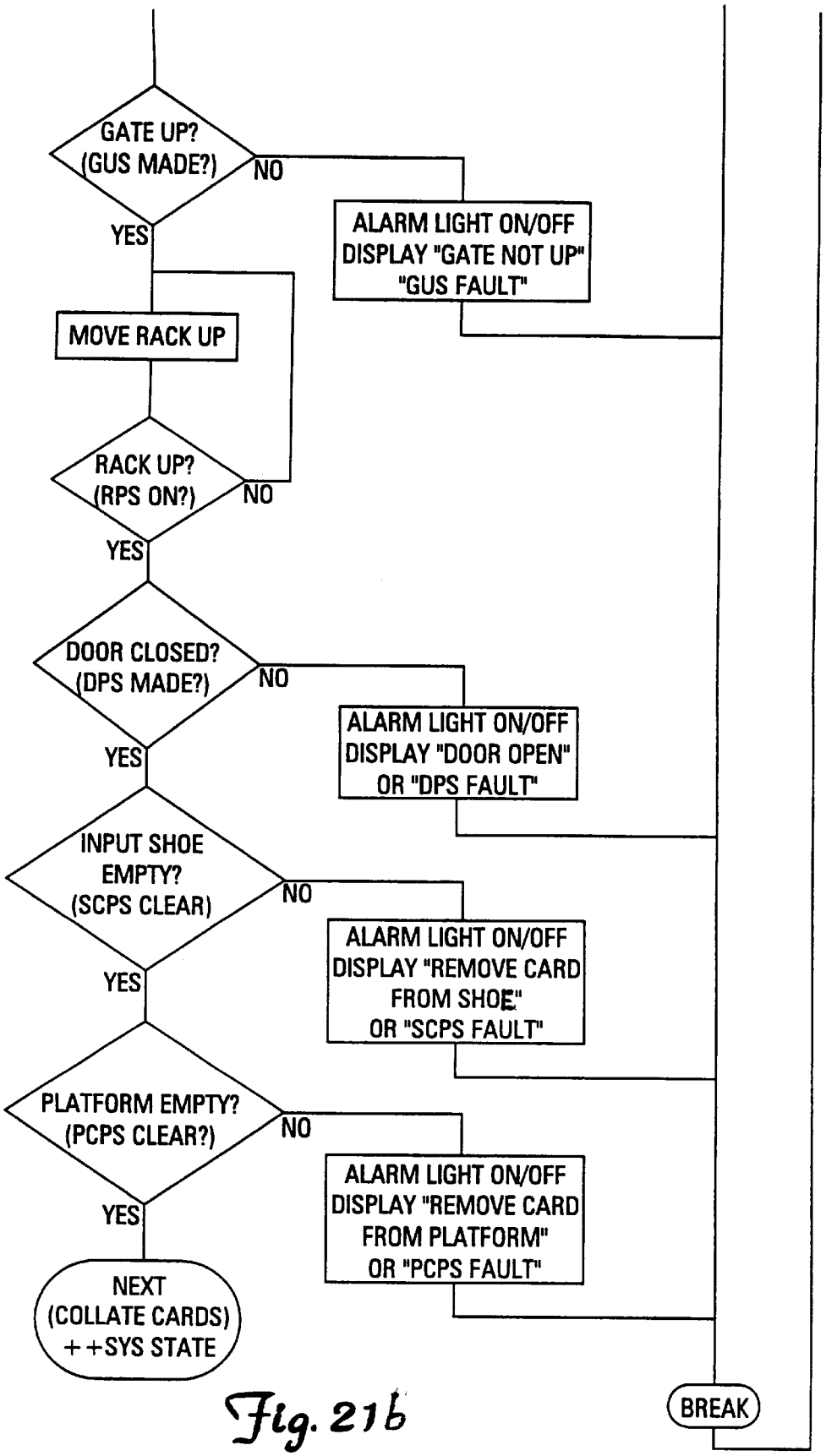
Figure 22A:
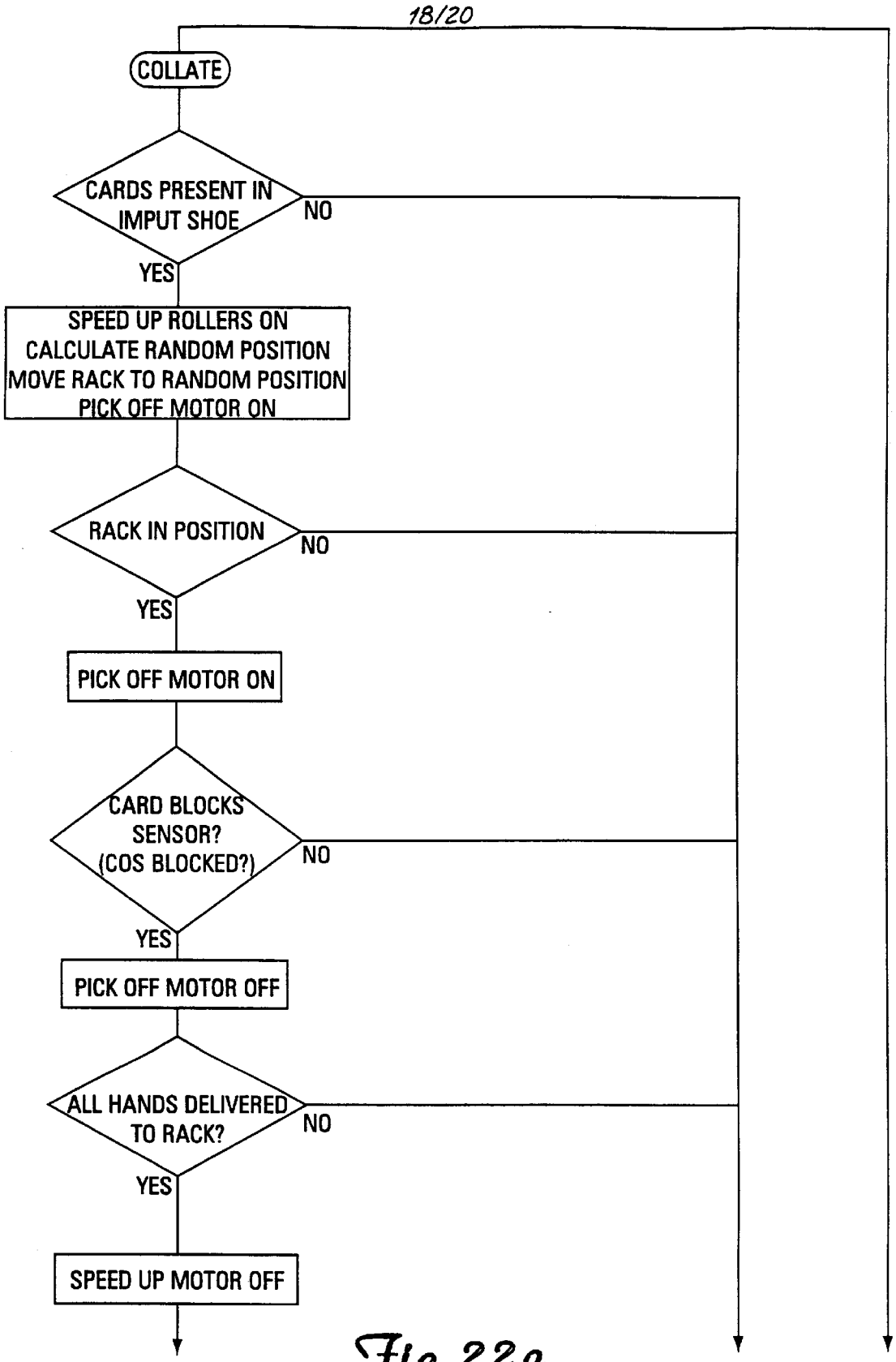
FIG. 22 is a flow diagram, comprising three parts, parts 22*a*, 22*b* and 22*c*, depicting a sequence of operation of the present invention.
Figure 22B:
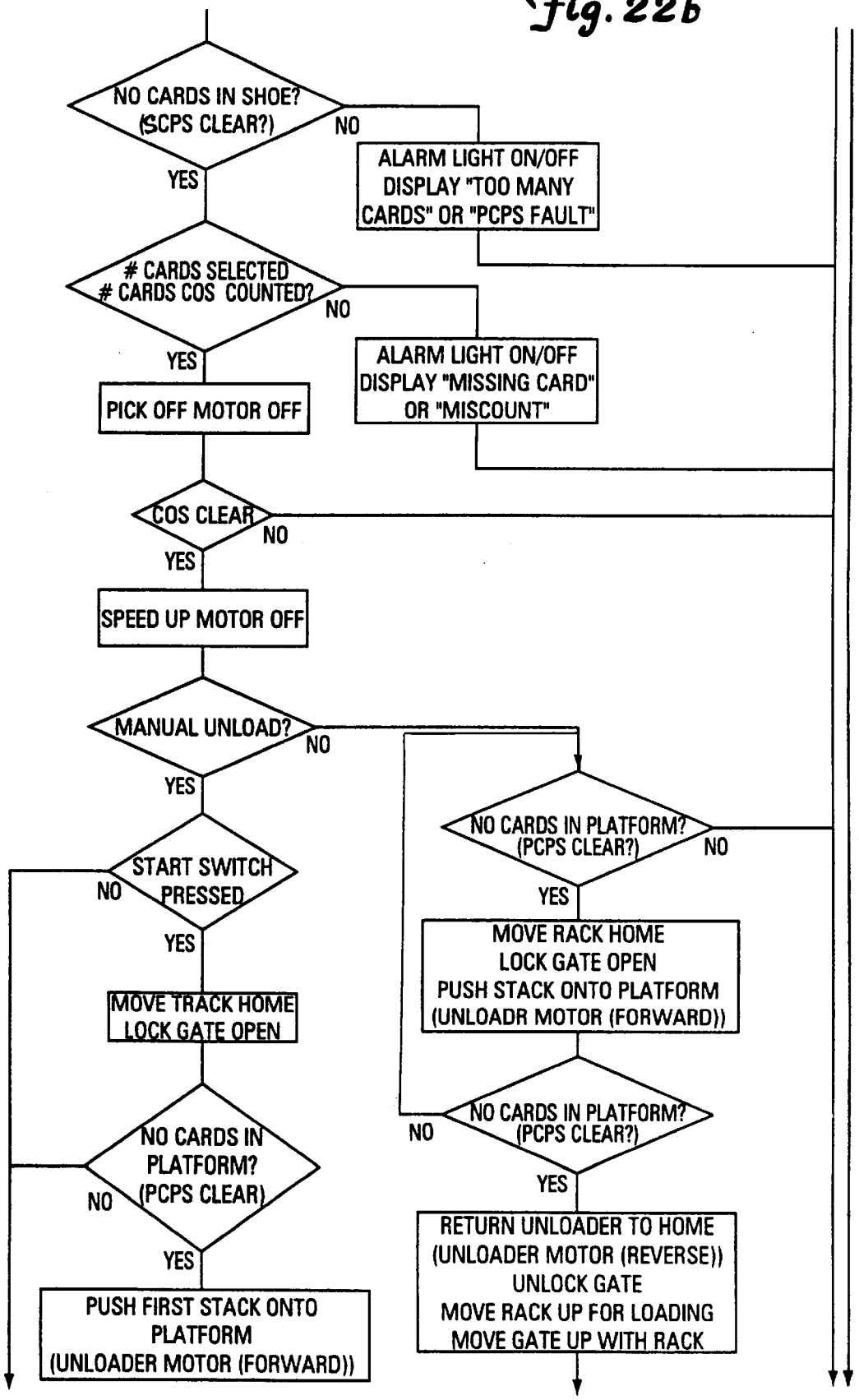
Figure 22C:
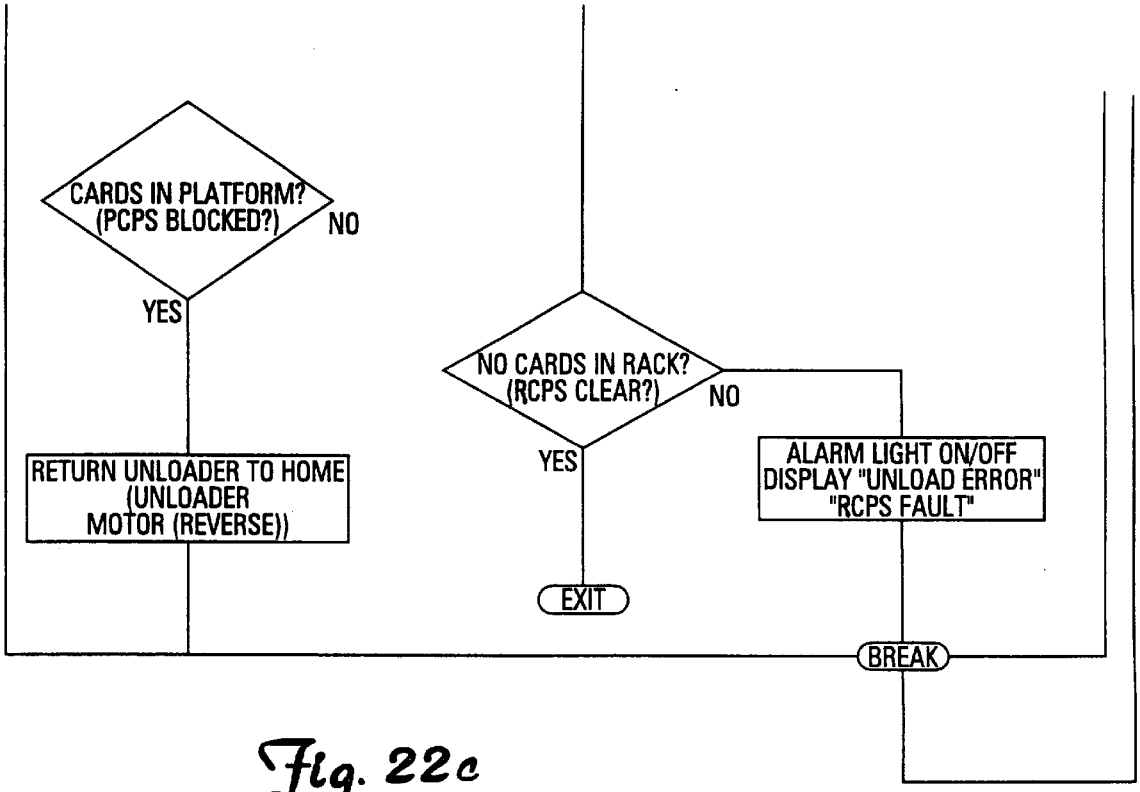

With reference to FIGS. 21 and 22, and Appendix C, which depict an operational program flow of the method and apparatus of the present invention, in use, cards are loaded into the well 60 by sliding or moving the block 68 generally rearwardly. The group of cards to be formed into hands is placed into the well 60 generally sideways, with the plane of the cards generally vertical, on one of the long side edges of the cards. The block 68 is released or replaced to urge the cards into an angular position generally corresponding to the angle of the angled card contacting face of the block 68, and into contact with the pick-up roller 150.

According to the present invention, the group of cards to be formed into hands is a single deck of standard playing cards. Depending upon the game, the group of cards can contain one or more wild cards, can be a standard deck with one or more cards removed, can comprise a special deck such as a Canasta or Spanish deck, for example, can include more than one deck, or can be a partial deck not previously recognized by those skilled in the art as a special deck. The present invention contemplates utilizing any group of cards suitable for playing a card game. For example, one use the device of the present invention to form hands for a cards game which requires the use of a standard deck of cards with all cards having a face value of 2–5 removed.

The card handling device of the present invention is well-suited for card games which deliver a fixed number of cards to each player. For example, the LET IT RIDE® stud poker game requires that the dealer deliver three cards to each player, and three cards to the dealer. For this application, the microprocessor is set so that only three card hands are formed.

When the power is turned on, the apparatus 20 homes (see FIG. 21 and Appendix B). The start input in actuated and the process cycle begins. As the cards are picked-up, i.e., after the separation of a card from the remainder of the group of cards in the well 60 is started, a card is accelerated by the speed-up system 160 and spit or moved past the plates 180, 182 into a selected compartment 106, 120. Substantially simultaneously, movement of subsequent cards is underway. The rack assembly 28 position relative to the position of the transport mechanism 30 is monitored, selected and timed by the microprocessor whereby a selected number of cards is delivered randomly to selected compartments until the selected number of compartments 106 each contain a randomized hand of a selected number of cards. The remainder of the cards are delivered to the discard compartment 120. Because the order in which the card is delivered is completely random the device may or may not deliver all cards in the initial group of cards to all compartments before the first player hand is pushed out of its compartment.

When all the cards have been delivered to the compartments, upon demand or automatically, the pusher 190 unloads one randomly selected hand at a time from a compartment 106 into the second card receiving platform 36. The pusher 190 may be triggered by the dealer or by the hand present sensor 212 associated with the second receiver 36. When the last hand is picked up and delivered to players and/or dealer, the larger discard compartment 120 automatically unloads. It should be appreciated that each cycle or operational sequence of the machine 20 goes through an entire group or deck of cards placed in the well 60 each time, even if only two players, i.e., two hands, are used.

Although a description of preferred embodiments has been presented, various changes including those mentioned above could be made without deviating from the spirit of the present invention. It is desired, therefore, that reference be made to the appended claims rather than to the foregoing description to indicate the scope of the invention.

APPENDIX A

| Item | Name | Description | |
|---|---|---|---|
| | | Switches and Sensors (Inputs) | |
| 212 | SCPS | Shoe Card Present Sensor | Omron * EE-SPY 302 |
| 116 | RCPS | Rack Card Present Sensor | Optek * 0P598A OP506A |
| | RHS | Rack Home Switch | Microswitch * SS 14A |
| | RPS | Rack Position Sensor | Omron * EE-SPZ401Y.01 |
| | UHS | Unloader Home Switch | Microswitch * SS14A |
| | DPS | Door Present Switch | Microswitch * SS14A |
| | PCPS | Platform Card Present Sensor | Omron * EE-SPY401 |
| 170 | CIS | Card In Sensor | Optek * OP506A |
| 176 | COS | Card Out Sensor | Optek * OP598A |
| | GUS | Gate Up Switch | Microswitch * SS14A |
| 44 | SS | Start Switch | EAO * 84-8512.5640 84-1101.0 84-7111.500 |
| | | Motors, Solenoid and Switches (Outputs) | |
| 154 | POM | Pick-off Motor | Superior * M041-47103 |
| 166 | SUM | Speed-up Motor | Superior * M041-47103 |
| 80 | RM | Rack Motor | Oriental * C7009-9012K |
| 198 | UM | Unloader Motor | Superior * M041-47103 |
| | FM | Fan Motor | Mechatronics * F6025L24B |
| 143 | GS | Gate Solenoid | Shindengen * F10308H w/return spring |
| | SSV | Scroll Switch - Vertical | EAO * 18-187.035 18-982.8 18-920.1 |
| | SSH | Scroll Switch - Horizontal | EAO * 18-187.035 18-982.8 18-920.1 |
| | AL | Alarm Light | Dialight * 557-1505-203 |

| | |
|---|---|
| Display | Noritake * CU20025ECPB - UIJ |
| Power Supply | Shindengen * ZB241R8 |
| Linear Guide | THK * RSR12ZMUU + 145M |
| Comm. Port | Digi * HR021 - ND |
| Power Switch | Digi * SW 323 - ND |
| Power Entry | Bergquist * LT - 101 - 3P |

APPENDIX B

| Homing/Power-up | |
|---|---|
| i. Unloader Home<br>Return unloader to home position. If it times out (jams), turn the alarm light on/off. Display "UNLOADER NOT HOME" "UHS FAULT". | UHS Made |
| ii. Door Present<br>Check door present switch (DPS). If it's not made, display "Door Open" "DPS Fault" and turn the alarm light on/off. | DPS Made |
| iii. Card Out Sensor (COS) Clear<br>If card out sensor is blocked: A. Check if Rack Card Present Sensor (RCPS) is blocked. If it is, drive card back (reverse both Pick-off Motor (POM) and Speed-up Motor (SUM)) until COS is clear. Keep the card in the pinch. Align rack and load card into one of the shelves. Then go through the rack empty sequence (3 below). B. If Rack Card Present Sensor (RCPS) is clear, drive card back towards the input shoe. Turn both the Speed Up Motor (SUM) and the Pick Off Motor on (reverse) until Card Out Sensor is clear plus time delay to drive the card out of the pinch. | COS Made |
| iv. Gate Up<br>Move rack up until the rack position sensor sees the top rack (RPS on). Gate up switch should be made (GUS). If not, display "GATE NOT UP" "GUS FAULT" and turn the alarm light on/off. | GUS Made |
| v. Rack Empty and Home<br>Check Rack Card Present Sensor (RCPS). If blocked, see emptying the racks. Return rack home when done.<br>INTERLOCK: Do not move rack if card out sensor is blocked (see 2 to clear) or when door is not present.<br>Emptying the racks: Go through the card unload sequence. Move rack down to home position. Energize solenoid. Move rack through the unload positions and unload all the cards. | RCPS Made<br>RHS Made |
| vi. Input Shoe Empty<br>If Shoe/Card Present Sensor (SCPS) is blocked, display "remove card from shoe" or "SCPS fault" and turn the alarm light on/off. | SCPS Clear |
| vii. Platform Empty<br>If Platform Card Present Sensor (PCPS) is blocked, display "remove card from platform" or "PCPS Fault" and turn alarm light on/off. | PCPS Clear |
| viii. Card in Sensor (CIS) Clear.<br>If Card In Sensor (CIS) is blocked, display "remove card from shoe" or "CIS fault" and turn the alarm light on/off. | CIS Made |
| **Start Position** | |
| Unloader Home | UHS Made |
| Rack Home | RHS Made |
| Rack Empty | RCPS Made |
| Door In Place | DPS Made |
| Card In Sensor Clear | CIS Made |
| Card Out Sensor Clear | COS Made |
| Gate Up | GUS Made |
| Platform Empty | PCPS Clear |
| Input Shoe Empty | SCPS Clear |
| Start Button Light On | |

APPENDIX C

| Recovery Routine | |
|---|---|
| Problem: | Card Jam - COS blocked too long. |
| Recovery: | 1. Stop rack movement.<br>2. Reverse both pick-off and speed-up motors until "COS" is unblocked. Stop motors.<br>3. If "COS" is unblocked, move rack home and back to the rack where the cards should be inserted.<br>4. Try again with a lower insertion point (higher rack) and slower insertion speed. If card goes in, continue insertion. If card jams, repeat with the preset positions, auto adjust to the new position. If jams become too frequent, display "check cards", replace cards. If it doesn't, repeat 1 and 2.<br>5. If "COS" is unblocked, move rack up to the top position and display "Card Jam"and turn alarm light on/off.<br>6. If "COS" is not unblocked after 2 or 4, display "card jam" and turn. . .(do not move rack to up position). |
| Problem: | Unloader jams on the way out. |
| Recovery: | Move unloader back home. Reposition rack with a small offset up or down and try again, lower speed if necessary. If unloader jams, keep repeating at the preset location, set a new value based on the offset which works (auto adjust). |

What is claimed is:

1. An apparatus for moving playing cards from a first group of cards into plural groups, each of said plural groups containing a random arrangement of cards, said apparatus comprising:

a card receiver for receiving the first group of unshuffled cards;

a single stack of card-receiving compartments generally adjacent to the card receiver, said stack generally adjacent to and movable with respect to the first group of cards; and a drive mechanism that moves the stack by means of translation relative to the first group of unshuffled cards;

a card-moving mechanism between the card receiver and the stack; and a processing unit that controls the card-moving mechanism and the drive mechanism so that a selected quantity of cards is moved into a selected number of compartments.

2. The apparatus according to claim 1, further comprising a second card moving mechanism adapted to empty one of the compartments after a selected quantity of cards is moved into said one of the compartments.

3. The apparatus according to claim 2, further comprising a second receiver for receiving the cards the second card moving mechanism moves out of the compartments.

4. The apparatus according to claim 1, further comprising a universal power supply operably connected to the card moving mechanism.

5. The apparatus of claim 1, wherein the stack is vertically translatable.

6. A playing card handler comprising:

a generally vertically oriented stack of mixing compartments for accumulating cards in at least one compartment;

a microprocessor programmed to randomly select the compartment which receives each card in a manner sufficient to accomplish randomly arranging the cards in each compartment, wherein the microprocessor is programable to deliver a preselected number of cards to a preselected number of compartments;

a card staging area for receiving a stack of cards to be handled, wherein the staging area and stack of mixing compartments are movable with respect to each other;

a drive mechanism responsive to output signals from the microprocessor for causing relative movement between the staging area and the stack of mixing compartments;

a card ejection device for moving a card from the staging area into one of the mixing compartments; and an input, operably connected to the microprocessor, that communicates a number of game participants and a number of cards to be dealt to each participant to the microprocessor.

7. The playing card handler according to claim 6, wherein number of compartments receiving cards corresponds to the number of game participants plus one.

8. An apparatus for moving playing cards from an unshuffled group of cards into a plurality of hands, each hand containing a random arrangement of the same quantity of cards, said apparatus comprising:

a card receiver for initially receiving the unshuffled group of cards;

a single stack of card-receiving compartments generally adjacent to the card receiver, said stack generally vertically translatable;

a card-moving mechanism between the card receiver and the stack; and a processing unit that controls the card-moving mechanism and the vertical movement of the stack so that a card is moved from the receiver into a randomly selected compartment and so that a selected number of cards are moved into a selected number of compartments.

9. The apparatus according to claim 8, further comprising a data storage medium accessible by the processing unit, wherein the data storage medium has a program stored on it, and wherein the program is configured to cause the processing unit to cause the card-moving mechanism to randomly move cards from the unshuffled group into the hands.

10. The apparatus according to claim 9, further comprising means for monitoring, recording and displaying the use of the apparatus.

11. The apparatus of claim 10, further comprising at least one sensor for monitoring the movement of cards, wherein during normal movement, the at least one sensor is alternately blocked and unblocked.

12. The apparatus according to claim 11, wherein the data storage medium is further configured to cause the processing unit to detect a card jam by sensing a prolonged block of the at least one sensor and to recover from the card jam by changing the movement of the cards.

13. A method of moving cards from a first group of cards into plural groups of cards, each of said plural groups containing random cards, said method comprising the steps of:

providing a card receiver for receiving the first group of cards;

providing a single stack of card-receiving compartments generally adjacent to the card receiver, said stack generally vertically translatable, and a drive adapted for translating the stack; and providing a card-moving mechanism between the card receiver and the stack and moving cards from the card receiver to the compartments.

14. The method according to claim 13, further comprising providing a processing unit for controlling the card-moving mechanism and the drive so that a selected quantity of cards is moved into a selected number of compartments.

15. The method according to claim 14, further comprising using the microprocessor to designate each card and select a compartment for receiving each designated card.

16. The method according to claim 15, wherein the designation and selection is performed before card moving operations begin.

17. A method for moving playing cards from an unshuffled group of cards into a plurality of hands, each hand containing a random arrangement of the same quantity of cards, said method comprising the steps of:

providing a card receiver for initially receiving the unshuffled group of cards;

providing a single stack of card-receiving compartments generally adjacent to the card receiver, said stack generally vertically translatable;

providing a card-moving mechanism between the card receiver and the stack for moving cards from the card receiver into the compartments; and providing a processing unit for controlling the card-moving mechanism and the vertical movement of the stack so that a card is moved from the card receiver into a randomly selected compartment and so that a selected number of cards are moved into a selected number of compartments, forming a plurality of randomly arranged hands.

18. A device for forming at least one randomized hand of cards comprising:

a card receiver for receiving at least one group of unrandomized cards;

a plurality of card receiving compartments comprising at least one hand forming compartment adapted to receive a randomized hand of cards and at least one discard compartment adapted to receive a group of discard cards;

a card moving device which transfers cards from the card receiver to one of said at least one hand forming compartments and at least one discard compartment, wherein the card moving device and card receiving compartments are mounted for relative motion; and a processing unit programmed to randomly assign each card in the group of unrandomized cards to a compartment, forming at least one randomized hand of cards and at least one group of discard cards.

19. The device according to claim 18, further comprising means for removing the at least one randomized hand from the at least one hand forming compartment.

20. The device according to claim 18, wherein each randomized hand contains three cards.

21. The device according to claim 18, wherein the plurality of compartments are arranged in a generally vertical stack, and the means for moving each card comprises an elevator operably coupled to the stack and to the frame.

22. The device according to claim 18, wherein the card moving device comprises a pick off roller.

23. A device for delivering at least one shuffled hand of cards comprising:

a card receiver for receiving at least one stack of unshuffled cards;

a plurality of individual compartments, comprising at least one hand forming compartment and at least one discard compartment;

a card moving mechanism adapted to move each card in the stack individually from the card receiver to a compartment; and a processing unit programmed to control the card moving mechanism, wherein the processing unit randomly assigns each card in the stack to a compartment, thereby forming at least one shuffled hand of cards in the at least one hand forming compartment and at least one stack of discard cards in the discard compartment, the at least one stack of discard cards comprising cards not used in forming the at least one randomized hand of cards.

24. The apparatus according to claim 23, wherein the at least one discard compartment is adapted to receive a greater number of cards than the at least one hand forming compartment.

25. The apparatus according to claim 23, wherein the at least one stack of discard cards may have a different number of cards than the at least one randomized hand of cards.

26. The apparatus according to claim 23, further comprising an input for communicating a number of game participants to the processing unit.

27. The apparatus according to claim 26, wherein the processing unit forms a number of shuffled hands equal to the number of game participants.

28. The apparatus according to claim 23, further comprising an input for communicating a number of cards to be dealt to each player to the processing unit.

29. The apparatus according to claim 36, wherein the at least one shuffled hand of cards comprises a number of cards equal to the number of cards to be dealt to each player.

30. A method of forming randomized hands of cards comprising the steps of:

providing a group of unshuffled cards;

providing a plurality of hand-forming compartments and at least one discard compartment;

randomly assigning each card in the group to a compartment, wherein each hand-forming compartment is assigned a predetermined number of cards and wherein the predetermined number of cards assigned to each hand forming compartment is equal; and delivering each card in the group to its randomly assigned compartment, forming at least one randomized hand of cards and at least one stack of discard cards, the at least one stack of discard cards comprising cards not used in forming the at least one randomized hand of cards.

31. The method according to claim 30, wherein seven hand forming compartments are provided.

32. The method according to claim 30, wherein the group of cards is a deck of cards selected from the group consisting of a standard 52 card deck, a standard deck with one or more wild cards, a standard deck with one or more jokers, a special deck and a partial deck.

33. The method according to claim 30, wherein every card in the group is assigned to a compartment before the first card is delivered.

34. The method according to claim 30, wherein the predetermined number of cards is three.

35. The method according to claim 30, wherein eight hand forming compartments and one discard compartment are provided, and wherein a group of unrandomized discard cards is formed in the discard compartment.

36. The method according to claim 30, wherein a dealer hand is formed and consists of the same number of cards as the at least one randomized hand.

37. The apparatus according to claim 24, wherein the at least one discard compartment is adapted to receive a greater number of cards than the plurality of hand-forming compartments.

38. The apparatus according to claim 24, wherein the at least one stack of discard cards may have a different number of cards than the at least one randomized hand of cards.

39. A device for delivering at least one shuffled hand of cards, comprising:

a card receiver for receiving at least one stack of unshuffled cards;

a plurality of hand forming compartments;

an input for communicating into a processing unit a number of cards to be dealt to each player; and a card moving mechanism, operably coupled to the processing unit, that moves each card in the stack of unshuffled cards to a randomly selected hand forming compartment, thereby forming at least one shuffled hand having a number of cards equal to the number of cards to be dealt to each player.

* * * * *